US010844567B2

(12) United States Patent
Green et al.

(10) Patent No.: US 10,844,567 B2
(45) Date of Patent: Nov. 24, 2020

(54) SOIL DENSIFICATION SYSTEM AND METHOD

(71) Applicant: Geopier Foundation Company, Inc., Davidson, NC (US)

(72) Inventors: Russell A. Green, Christiansburg, VA (US); Kord J. Wissmann, Mooresville, NC (US); John Verdin, Lovettsville, VA (US)

(73) Assignee: GEOPIER FOUNDATION COMPANY, INC., Davidson, NC (US)

( * ) Notice: Subject to any disclaimer, the term of this patent is extended or adjusted under 35 U.S.C. 154(b) by 0 days.

(21) Appl. No.: 15/369,717

(22) Filed: Dec. 5, 2016

(65) Prior Publication Data

US 2017/0081820 A1 Mar. 23, 2017

Related U.S. Application Data

(63) Continuation of application No. 14/072,562, filed on Nov. 5, 2013, now Pat. No. 9,512,586.

(Continued)

(51) Int. Cl.

| | |
|---|---|
| ***E02D 3/12*** | (2006.01) |
| ***E03D 3/00*** | (2006.01) |
| ***E02D 3/02*** | (2006.01) |
| ***E02B 11/00*** | (2006.01) |
| ***E02D 3/00*** | (2006.01) |

(52) U.S. Cl.

CPC ..... *E02D 3/12* (2013.01); *E02B 11/005* (2013.01); *E02D 3/00* (2013.01); *E02D 3/02* (2013.01); *E02D 2250/003* (2013.01); *E02D 2300/002* (2013.01); *E02D 2300/0003* (2013.01); *E02D 2300/0079* (2013.01); *E02D 2600/40* (2013.01)

(58) Field of Classification Search

CPC ..... E02D 3/02; E02D 3/12; E02B 11/005
USPC ..... 405/258.1, 271
See application file for complete search history.

(56) References Cited

U.S. PATENT DOCUMENTS 1,598,300 A * 8/1926 Moran ..... E02D 3/10 405/271
1,650,081 A * 11/1927 Lycurgus ..... A01B 79/00 111/7.1

(Continued)

FOREIGN PATENT DOCUMENTS

DE 4125576 A1 * 2/1993 ..... E02D 3/12
DE 4304816 A1 * 8/1994 ..... G01N 1/08
DE 4417887 A1 * 11/1995 ..... E03D 3/12

*Primary Examiner* — Tara Mayo-Pinnock
(74) *Attorney, Agent, or Firm* — E. Eric Mills; Nexsen Pruet, PLLC

(57) ABSTRACT

A soil densification system and method is disclosed. The presently disclosed soil densification system includes an air delivery probe or pipe that can be driven or otherwise installed into a soil mass. An inlet of the air delivery probe is supplied by an air compressor and an air storage tank, which are used for the rapid delivery of air impulses or bursts into the air delivery probe, whereas the air impulses or bursts are expelled out of an outlet of the air delivery probe and into the soil mass. The method of using the presently disclosed soil densification system includes the steps of inserting the end of the air delivery probe into the soil mass to any desired depth and then releasing an impulse or burst of air into the soil mass, thereby forming a densified region in the soil mass via the forces of the air impulse.

21 Claims, 19 Drawing Sheets

Related U.S. Application Data

(60) Provisional application No. 61/722,269, filed on Nov. 5, 2012.

(56) References Cited

U.S. PATENT DOCUMENTS

| | | | | | |
|---|---|---|---|---|---|
| 1,677,153 | A | | 7/1928 | Spencer | |
| 2,719,029 | A | | 9/1955 | Steuerman | |
| 3,386,251 | A | | 6/1968 | Casagrande et al. | |
| 3,707,848 | A | | 1/1973 | Chelminski | |
| 4,112,692 | A | | 9/1978 | Anderson et al. | |
| 4,397,588 | A | | 8/1983 | Goughnour | |
| 4,449,856 | A | | 5/1984 | Tokoro et al. | |
| 5,032,042 | A | | 7/1991 | Schuring et al. | |
| 5,219,247 | A | | 6/1993 | Gemmi et al. | |
| 5,282,699 | A | | 2/1994 | Hodge | |
| 5,353,724 | A | * | 10/1994 | Wheeley, Jr. ..... | A01B 29/06 111/118 |
| 5,401,121 | A | * | 3/1995 | Nakashima ..... | E02D 3/12 405/233 |
| 6,328,503 | B1 | | 12/2001 | Fujiwara | |
| 6,973,885 | B2 | | 12/2005 | Fulgham | |
| 2004/0115011 | A1 | | 6/2004 | Fox | |
| 2006/0275087 | A1 | | 12/2006 | Trout | |

* cited by examiner

[STEP 1065]

[STEP 1045 (X2)]

[STEP 1055 (X2)]

[STEP 1045 (X3)]

[STEP 1055 (X3)]

SOIL DENSIFICATION SYSTEM AND METHOD

CROSS REFERENCE TO RELATED APPLICATION

This patent application is a continuation application of U.S. patent application Ser. No. 14/072,562 filed Nov. 5, 2013, which is related to and claims priority to U.S. Provisional Application Ser. No. 61/722,269 filed Nov. 5, 2012, the entire disclosure of which is specifically incorporated by reference herein.

TECHNICAL FIELD

The presently disclosed subject matter relates generally to methods of stabilizing soil and more particularly to a soil densification system and method. In particular, the invention is directed to improving the strength, stiffness, and density of soil by displacing soil with bursts of air, with the air bursts being at a pressure greater than atmospheric pressure. Voids created using this method can be filled by the overlying native material collapsing into the voids or by filling with flowable media such as, for example, sand, gravel, recycled materials, waste materials, tire chips, grout, or concrete.

BACKGROUND

Buildings and other structures located in areas containing loose granular soils may be subject to excessive settlement as soil densifies and settles during static or dynamic loading. Soil densification by dynamic loads may be caused by reciprocating machinery, applications of dynamic loads such as wind loads, or by earthquakes. Earthquakes occur as a result of tectonic activity. When earthquakes occur, they shake the bedrock in the vicinity of the fault rupture that results in compressive and shearing stresses applied to the soil column above the rock.

Seismically-induced waves propagate upwards through the soil profile, often resulting in damage to existing structures. This damage can sometimes be caused by soil liquefaction that results from shaking. Liquefaction is a phenomenon that occurs in saturated soils that involves the transfer of the effective overburden load from the soil grains to the pore fluid, with the commensurate reduction in effective stress and, hence, reduction in soil strength. Pore fluid is the groundwater held within a soil or rock; namely, in the gaps between particles (i.e., in the pores). Pore water pressure refers to the groundwater pressure within the pores of the soil or rock. In earthquake-induced liquefaction, this transfer is initiated in sandy soils by the collapse of the soil skeleton due to earthquake shaking. Following liquefaction, settlement occurs as the pore water pressures dissipate. Soil liquefaction can result in billions of dollars in structural damage and can lead to a loss of life. Examples of the devastating effects of soil liquefaction can be found in the aftermath of destruction from the recent Haiti, Conception Chile, and Christchurch New Zealand earthquakes.

One way to support structures to minimize damage from the densifying of loose soil during static and dynamic loading is by using deep foundation elements. Such deep foundations are typically made from driven pilings or concrete piers installed by drilling. The deep foundations are designed to transfer structural loads through the soft and loose soils to more competent soil strata. Deep foundations are often relatively expensive when compared to other construction methods. Further, the design of deep foundation elements must consider the deleterious effects of liquefaction such as reduction in the supporting capacity of the now liquefied soil in response to applied vertical and lateral loads.

More recently, ground reinforcement with aggregate columns has been used to support structures located in areas containing loose and weak soil. The columns are designed to reinforce and strengthen the soft layers and reduce settlements. Such piers are constructed using a variety of methods. For example, piers that are constructed using drilling and tamping methods are described in U.S. Pat. No. 5,249,892, entitled "Short Aggregate Piers and Method and Apparatus for Producing Same," issued on Oct. 5, 1993; and U.S. Pat. No. 6,354,766, entitled "Methods for Forming a Short Aggregate Pier and a Product Formed from said Methods," issued on Mar. 12, 2002. Piers that are constructed using driven mandrel methods are described in U.S. Pat. No. 6,425,713, entitled "Lateral Displacement Pier, and Apparatus and Method of Forming the Same," issued on Jul. 30, 2002. Piers that are constructed using tamping head driven mandrel methods are described in U.S. Pat. No. 7,226,246, entitled "Apparatus and Method for Building Support Piers from One or Successive Lifts Formed in a Soil Matrix," issued on Jun. 5, 2007; and U.S. Pat. No. 7,326,004, entitled "Apparatus for Providing a Rammed Aggregate Pier," issued on Feb. 5, 2008. Each of these methods requires that aggregate, such as crushed limestone, be imported to the site and placed in the cavity and is generally only efficient to depths of 40 feet (12.2 m).

As an alternative to deep foundations and aggregate columns, the loose sand can be excavated and then the excavation refilled with more competent material. This method is advantageous because it is performed with conventional earthwork methods, but has the disadvantages of (1) being costly when performed in urban areas; (2) may require costly dewatering or shoring be performed to stabilize the excavation; and (3) is often impractical and environmentally insensitive.

Alternatively, the loose sand can be densified in-place. One way to perform soil densification in-place is by using a technique known as "deep dynamic compaction." Deep dynamic compaction consists of dropping a heavy weight on the ground surface in order to cause a large compression wave to develop in the soil, wherein the compression wave compacts the soil (provided the soil is of a sufficient gradation to be treatable). A variety of weight shapes are available to achieve compaction by this method, such as those described in U.S. Pat. No. 6,505,998, entitled "Ground Treatment," issued on Jan. 14, 2003. While deep dynamic compaction may be economical for certain sites, it has the disadvantage that it induces large waves in the soil. These waves may be damaging to surrounding structures. The technique is also deficient because it is only applicable to a small band of soil gradations (particle sizes) and is not suitable for materials with appreciable fine-sized particles. Deep dynamic compaction is further limited by practical treatment depths of 30 ft (9.1 m) or less.

Yet another way to perform soil densification is by using a technique known as vibroflotation, wherein vibrators are lowered into the ground. While vibroflotation methods are effective at treating liquefaction, vibroflotation methods may be slow and require powerful mechanical vibrators that consume large amounts of energy.

Still another way to perform soil densification is by explosive methods (i.e., explosive blasting using TNT or other chemical explosives placed within boreholes). Explosive blasting causes shock waves to be generated in the ground after the explosive charges have been detonated. While explosive blasting has been used successfully at great depths below dams and other large structures, blasting is dangerous and requires great care in its execution.

Yet another recent method of providing soil densification includes the "Densipact®" method, such as described in U.S. Pat. No. 8,328,470, entitled "Apparatus and Method for Ground Improvement," issued on Dec. 11, 2012. In the '470 patent, a tool utilizing a plurality of downwardly extending tines is driven into the soil in order to displace the ground material downward and radially outward. Repeated retraction and driving of the tines can achieve densification.

The present invention is an improvement on such prior techniques, and in particular, deep dynamic compaction and vibroflotation. Deep dynamic compaction and vibroflotation both decrease static and dynamic settlement potential by densifying deposits of clean granular soils. Deep dynamic compaction is generally only efficient at improving the relative density of soil deposits less than 30 ft (9.1 m) in depth. Vibroflotation requires the operation of a powerful mechanical vibrator, a process that consumes energy and is relatively slow. The present invention is not limited by depth and can be performed with relatively small equipment and relatively quickly.

SUMMARY

In one embodiment of the present invention, an apparatus for controlled air burst densification in a soil mass is provided, the apparatus including a primary tube, one or more ports formed in the primary tube, and a pressurized air system connected to the primary tube, wherein the air system is configured for providing a pressurized air impulse at the one or more ports and in to a soil mass.

The lower end of the primary tube may comprise one of the one or more ports and the one or more ports may comprise at least one of an open end of the tube and a valve/nozzle operable between an open and a closed position. The valve/nozzle may comprise a bulb-type nozzle that nests with the open end of the tube and is operable between an open position and a closed nested position.

The apparatus may comprise a cover covering the one or more ports and the cover may comprise a sacrificial cap.

The pressurized air system may comprise a stored volume of compressed air connected to an air source wherein the stored volume of compressed air may be stored in a compressed air storage tank and probe, wherein the air source may comprise an air compressor, or wherein the air source may be configured to recharge the stored volume of compressed air at a rate equal to a discharge volume of air resulting from the air impulse. The apparatus may comprise a control valve located between the stored volume of compressed air and the one or more ports.

The one or more ports of the apparatus may comprise a plurality of ports spaced along a length of the primary tube and the primary tube may comprise a shutter system for selectively opening or closing the plurality of ports spaced along a length of the primary tube.

The apparatus may comprise a plurality of primary tubes and the primary tubes may be configured to provide substantially simultaneous or sequential air impulses.

The primary tube may be configured for delivering flowable media into a void in the soil mass resulting from the air impulse. The flowable media may comprise one or more of sand, gravel, recycled materials, waste materials, tire chips, concrete, or grout.

The apparatus may further comprise a secondary tube for delivering flowable media into a void in the soil mass resulting from the air impulse. The primary tube may be internal to and concentric with the secondary tube wherein the offset between the primary tube and secondary tube is substantially constant. The secondary tube may be external to and alongside the primary tube. The primary tube may be internal to and alongside the secondary tube wherein the offset between the primary tube and secondary tube is not constant.

In another embodiment of the present invention, a method of controlled air burst densification in a soil mass is provided, the method comprising providing an apparatus for controlled air soil densification including a primary tube, one or more ports formed in the primary tube, and a pressurized air system connected to the primary tube, wherein the air system is configured for providing a pressurized air impulse at the one or more ports and in to a soil mass. The method further comprises inserting an end portion of the primary tube to a desired soil treatment level depth in the soil mass, releasing an air impulse at the one or more ports to form a void surrounded by a zone of densification, and filling the void in the soil mass created by the air impulse at the one or more ports.

The one of more ports may comprise at least one of an open end of the tube and a valve/nozzle operable between an open and a closed position wherein the valve/nozzle is placed in the closed position upon insertion of the primary tube in the soil mass and is placed in the open position upon releasing of the air impulse.

The one or more ports may comprise a plurality of ports spaced along a length of the primary tube and the primary tube may contain a shutter system for selectively opening or closing the plurality of ports spaced along a length of the primary tube, wherein the shutter is placed in the closed position upon insertion of the primary tube in the soil mass and is placed in the open position upon releasing of the air impulse.

The void created by the method may be filled with flowable media via the primary tube or via a secondary tube. The void may also be filled by loose soil that collapses from above the zone of densification to fill the void.

The step of releasing an air impulse may be repeated more than one time at a given elevation.

The method may further comprise raising the primary tube up a determined distance after filling the void, providing a subsequent air impulse, and filling a resulting void created by the subsequent air impulse. The steps of raising the primary tube up the determined distance after filling the void, providing the subsequent air impulse, and filling the resulting void created by the subsequent air impulse may be repeated until the required treatment depth is complete.

The method may comprise treating a single column of material or treating multiple columns of material.

The method may further comprise the insertion of prefabricated vertical drains into the soil mass to facilitate rapid egress of water from the soil mass.

BRIEF DESCRIPTION OF THE DRAWINGS

Figure 1A:
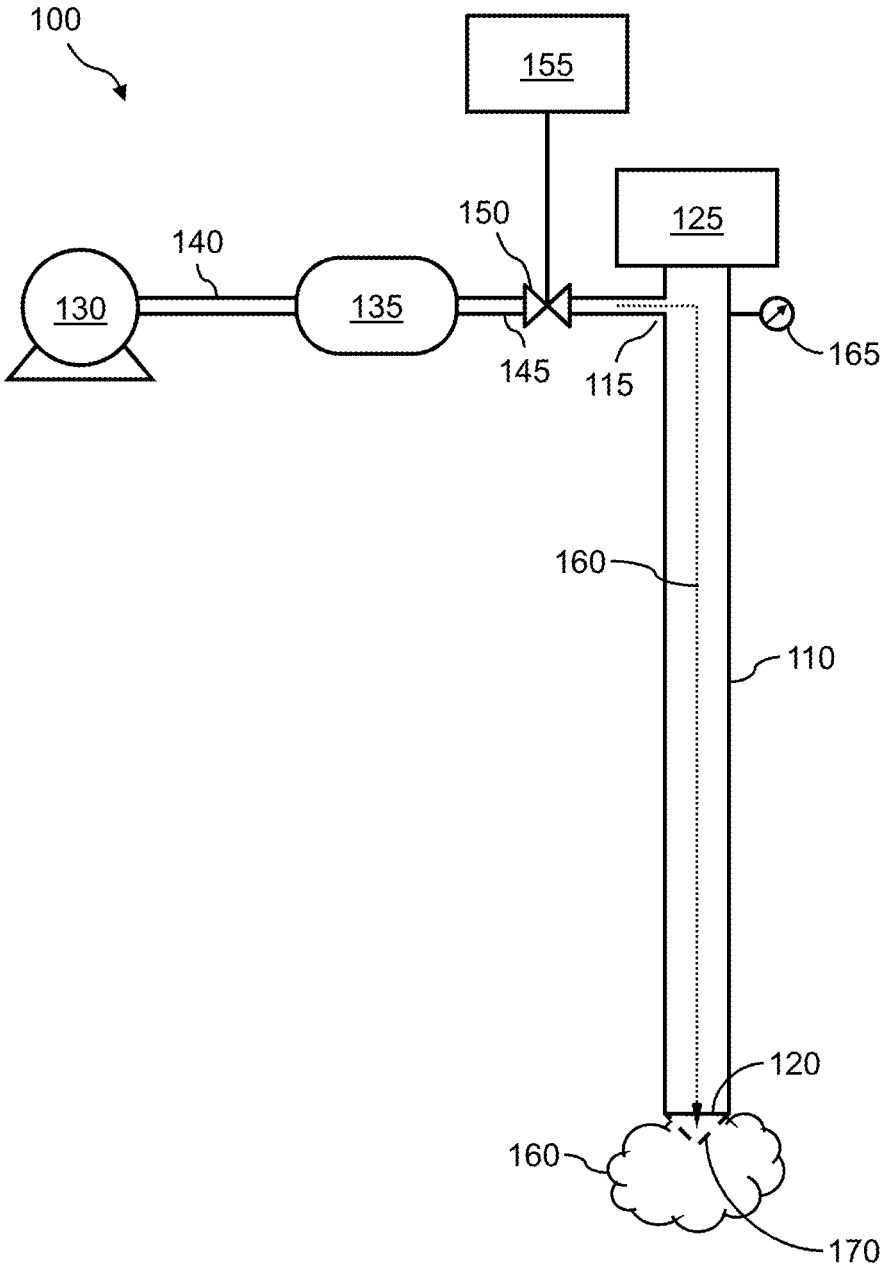
Figure 1B:
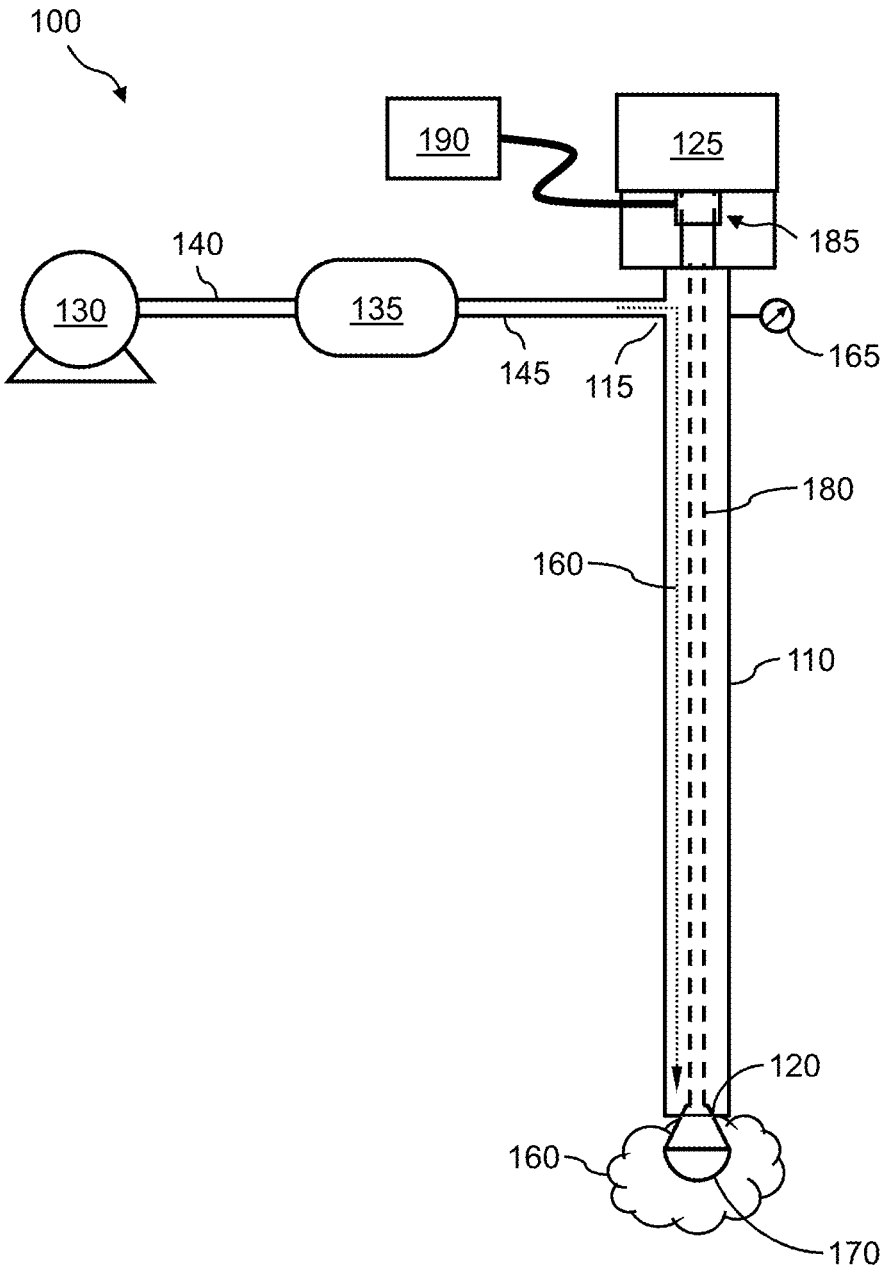
Figure 2A:
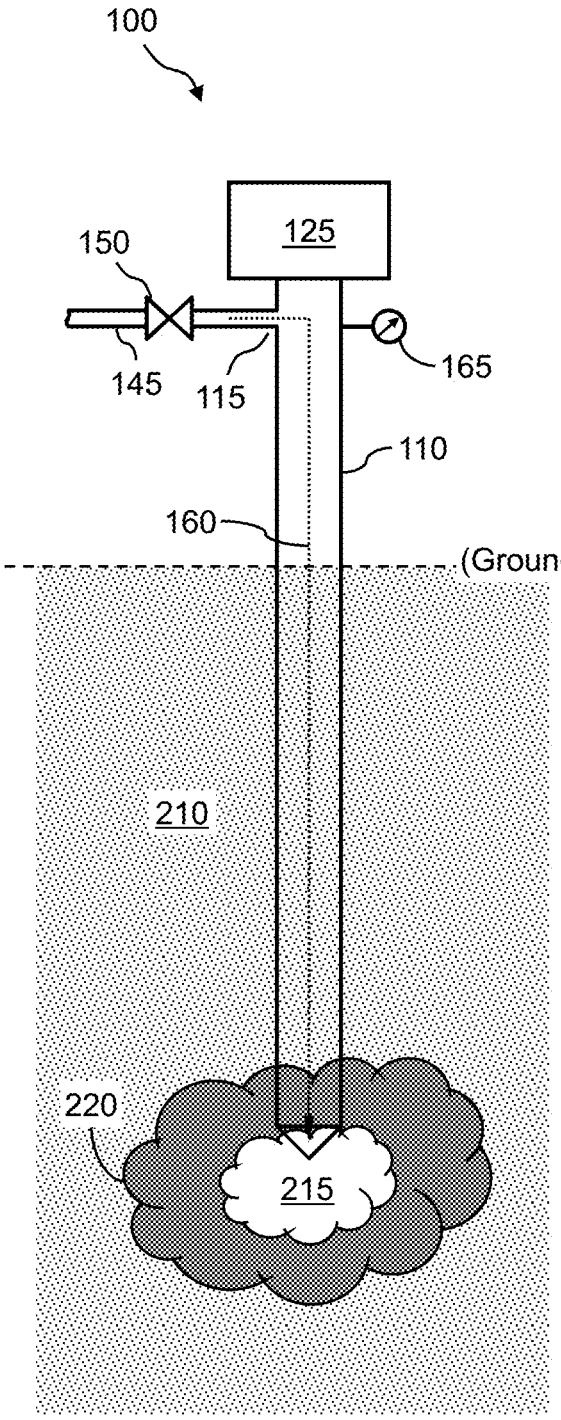
Figure 2B:
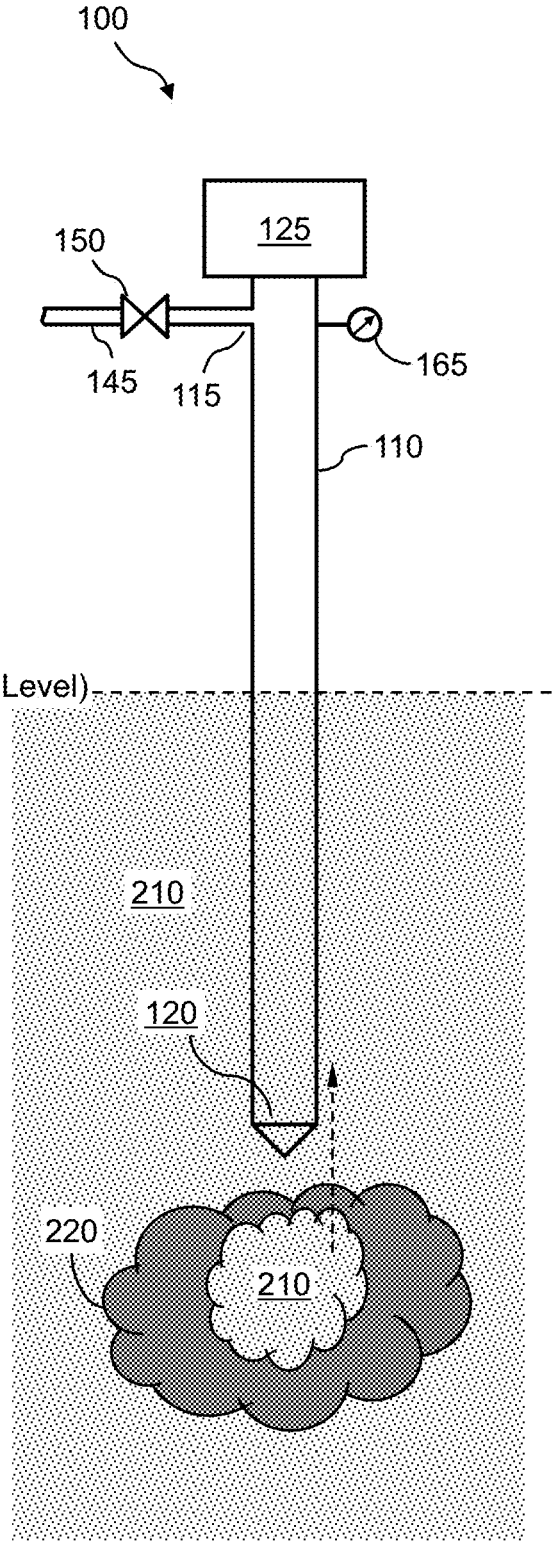
Figure 2C:
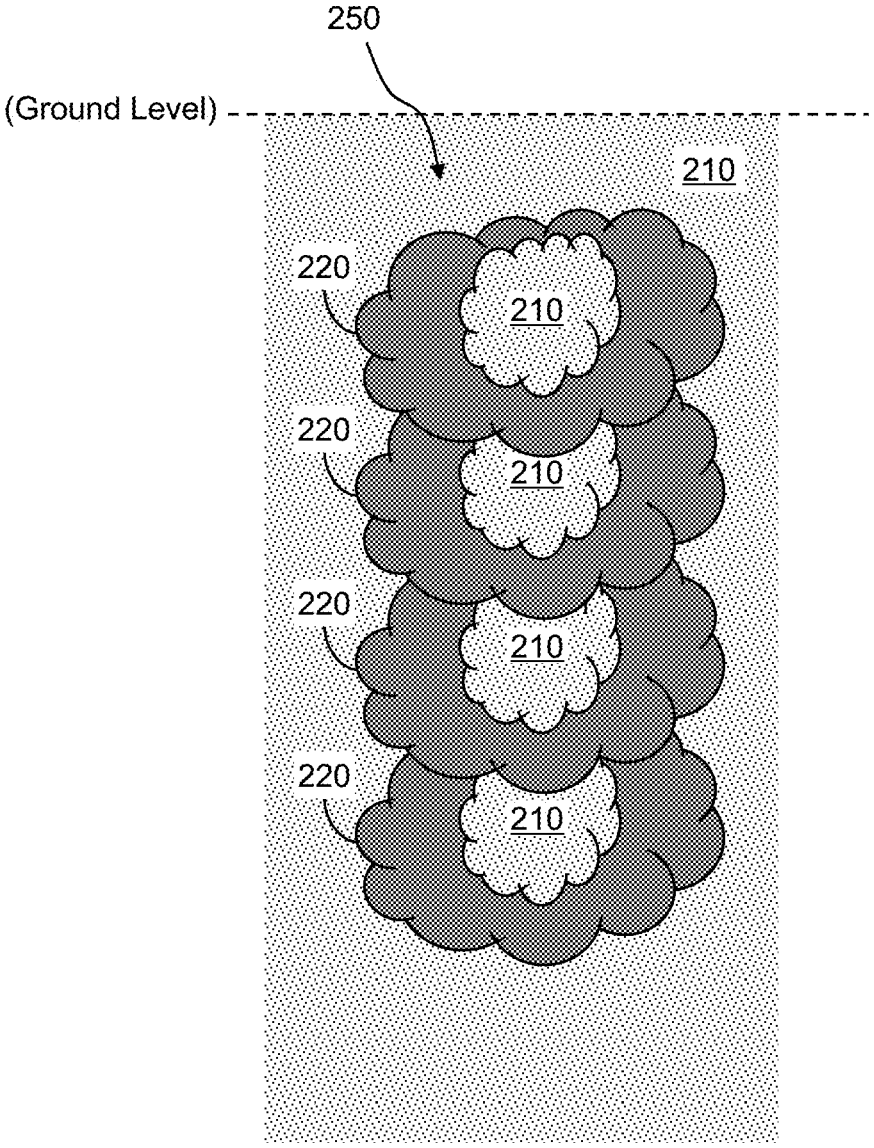
Figure 3:
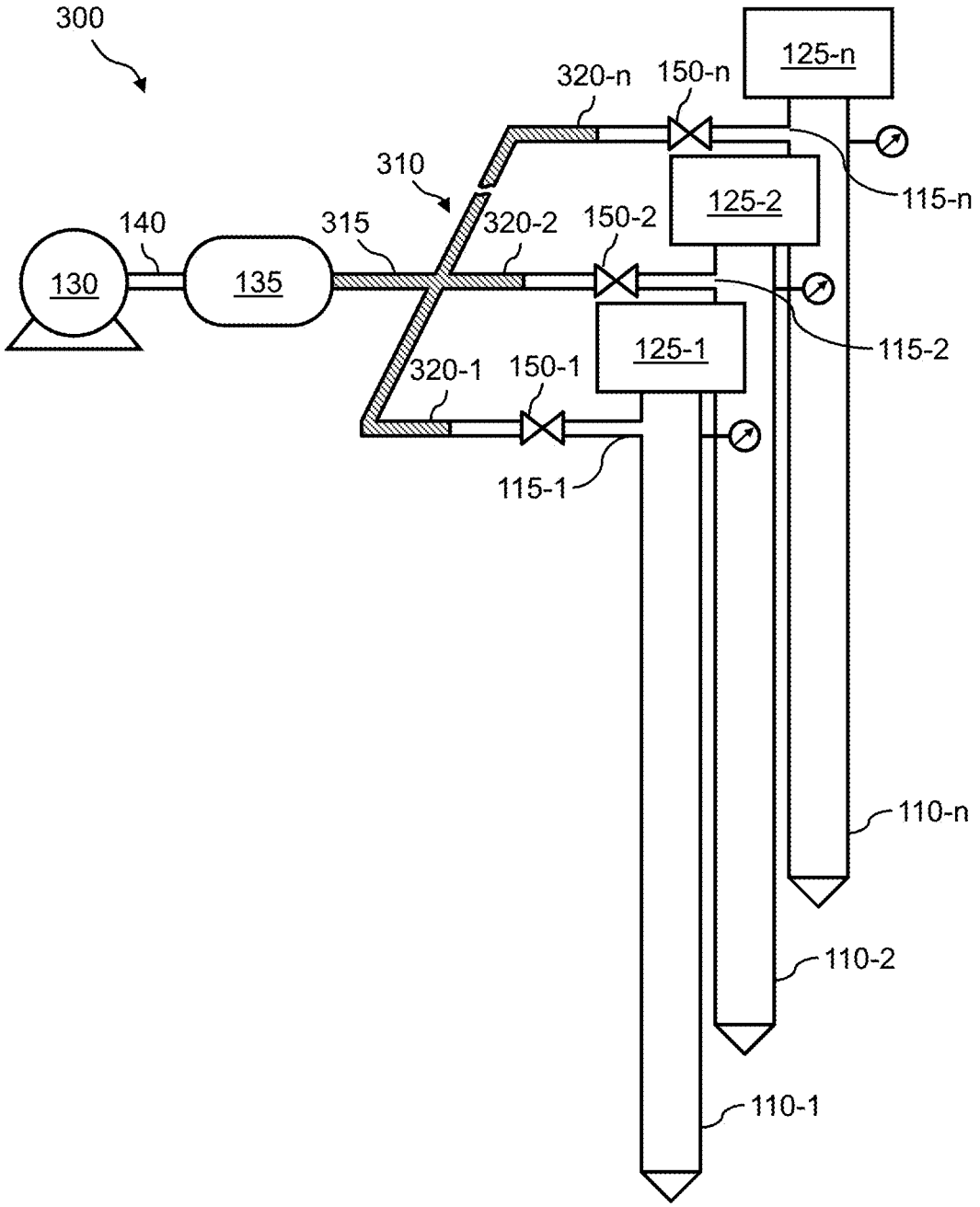
Figure 4A:
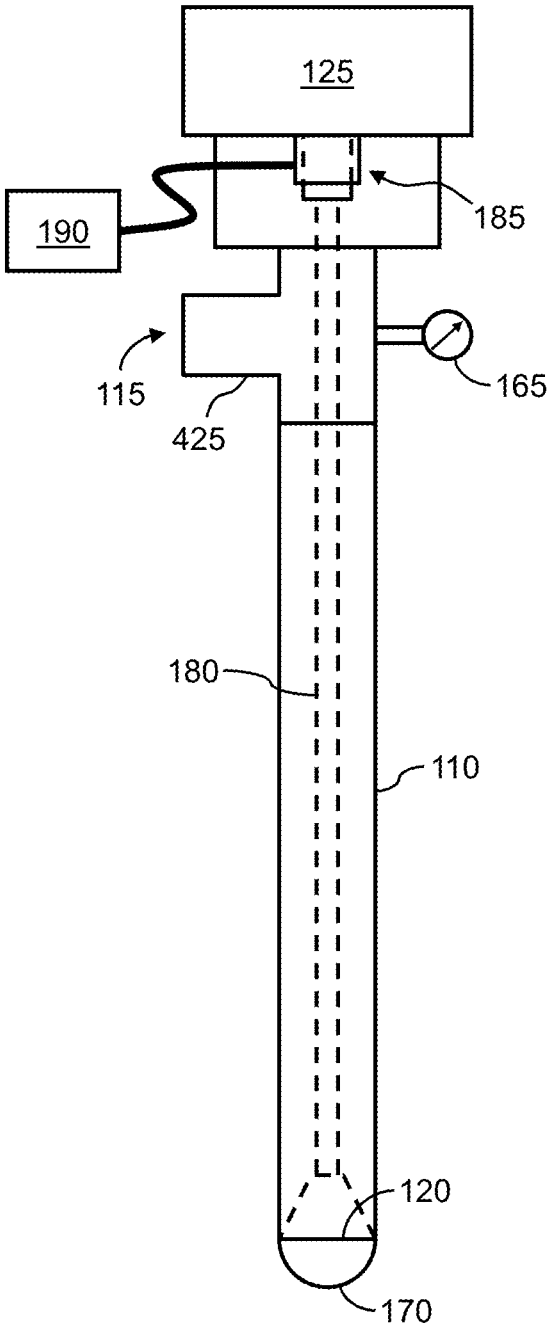
Figure 4B:
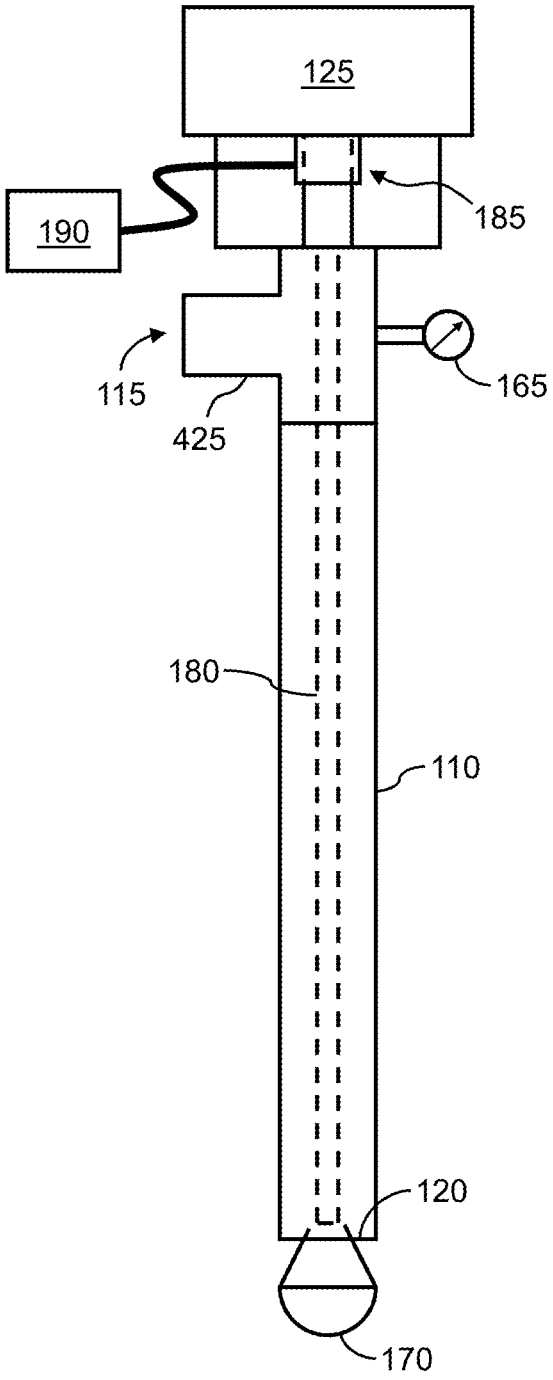
Figure 5A:
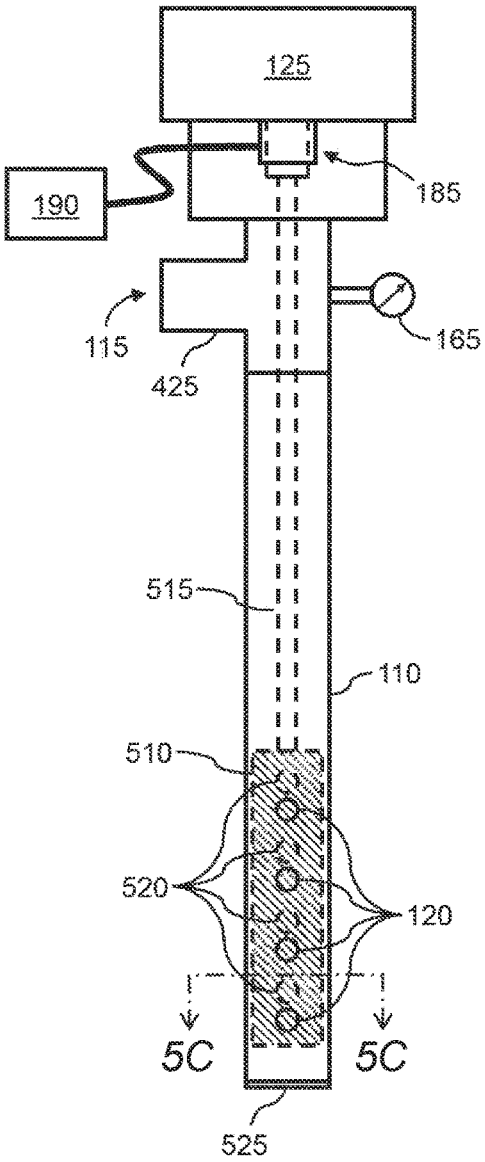
Figure 5C:
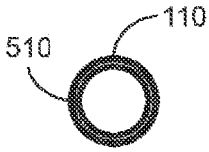
Figure 5B:
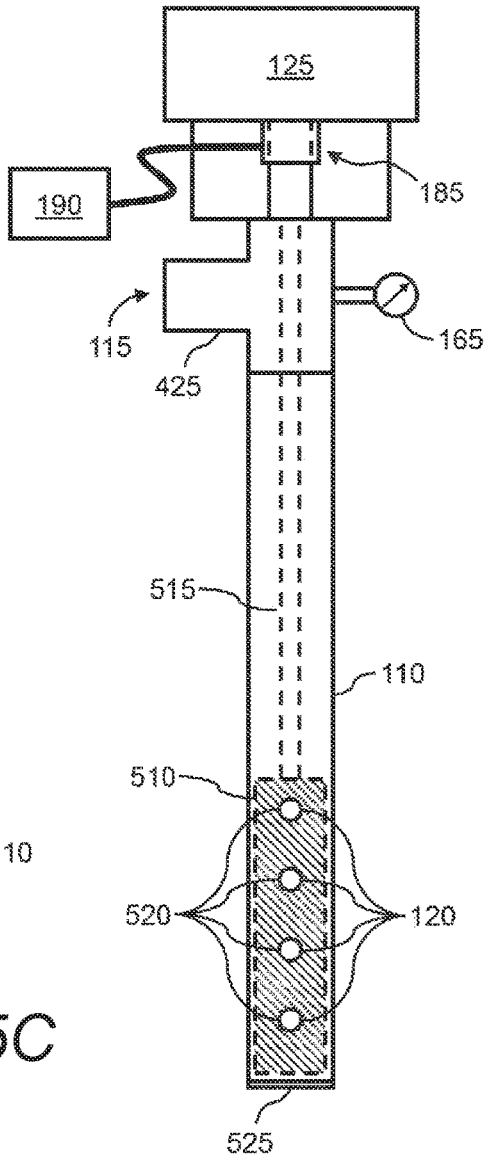
Figure 6:
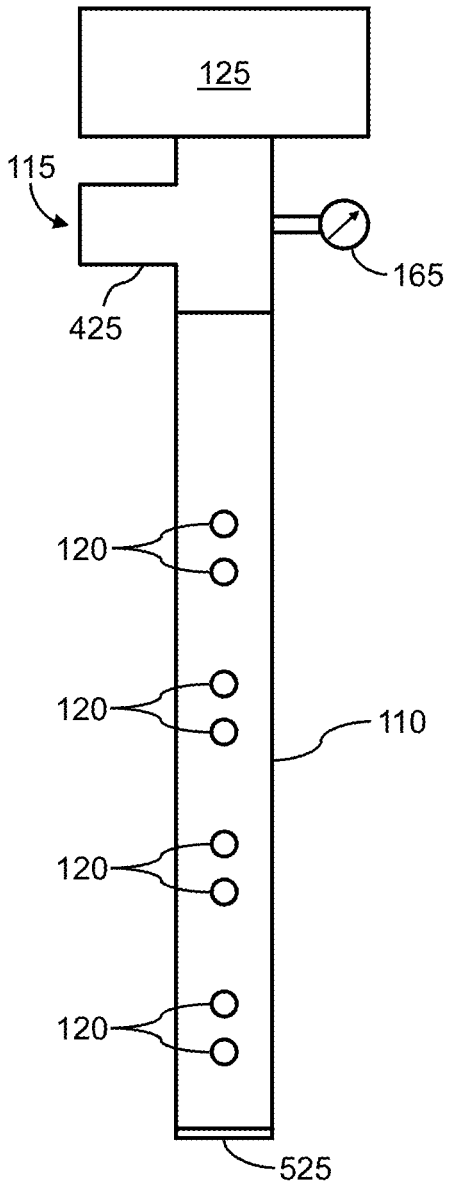
Figure 7A:
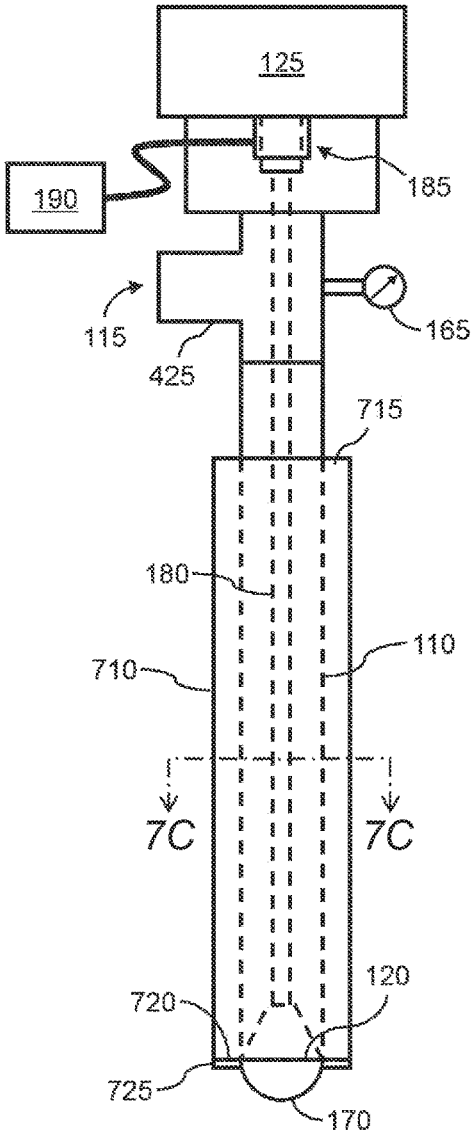
Figure 7C:
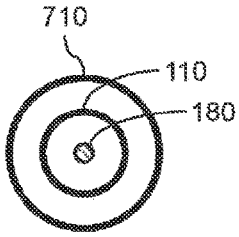
Figure 7B:
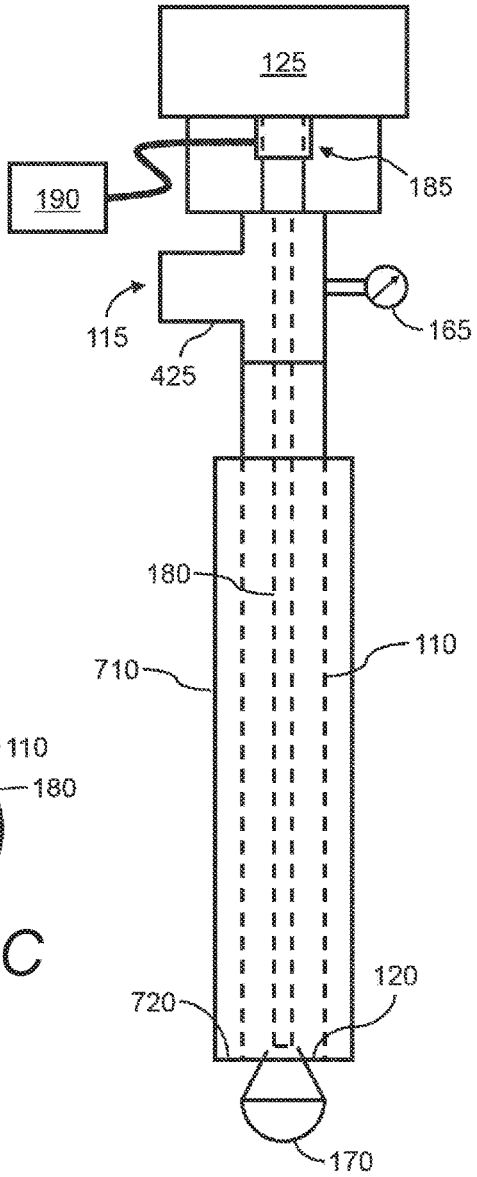
Figure 8A:
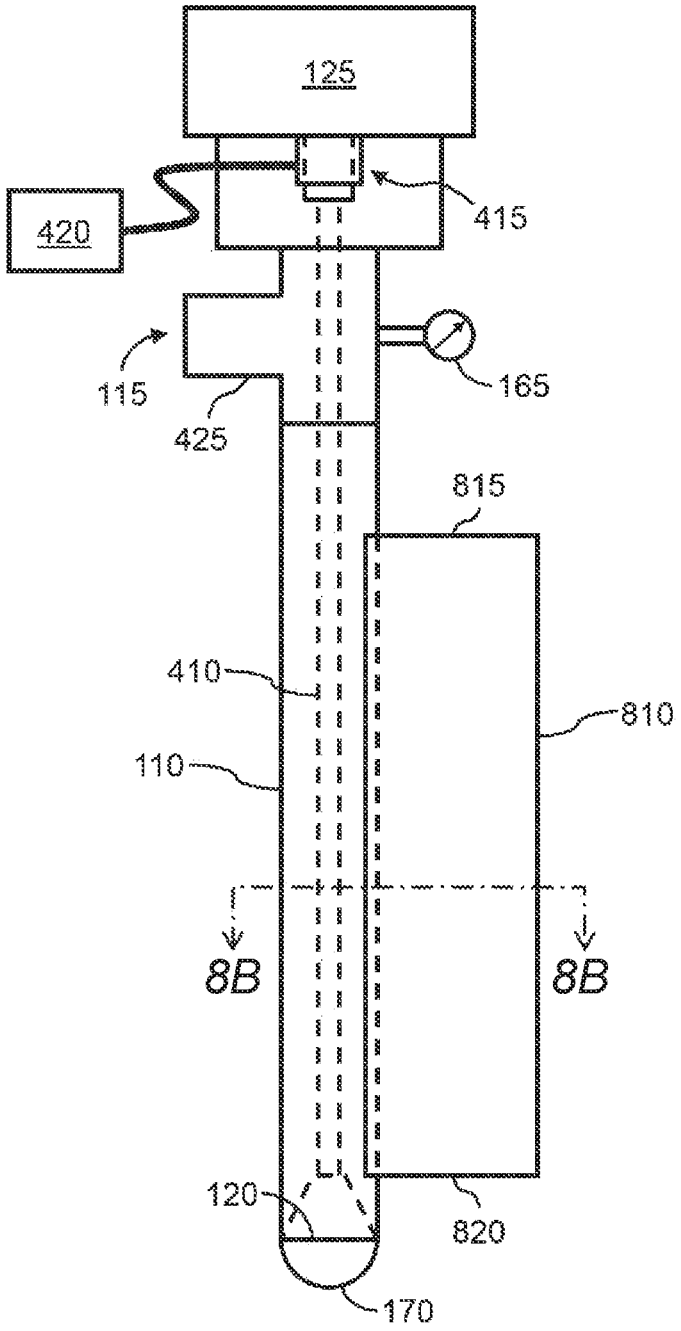
Figure 8B:
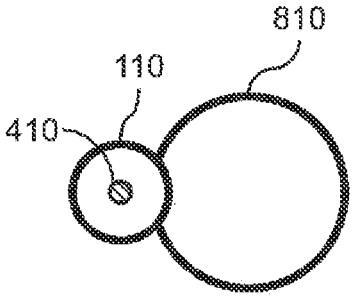
Figure 9A:
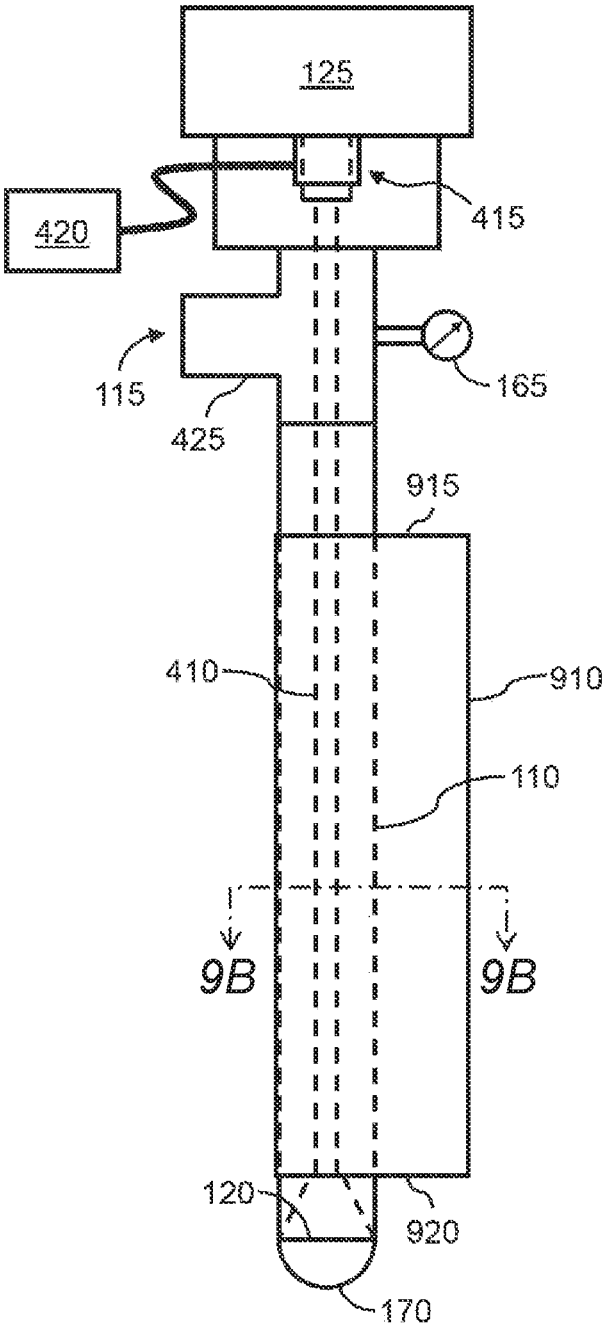
Figure 9B:
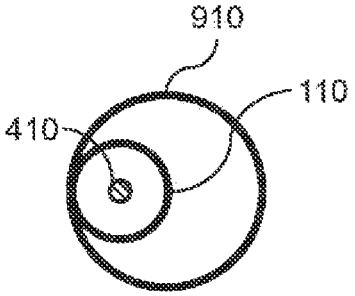
Figure 10A:
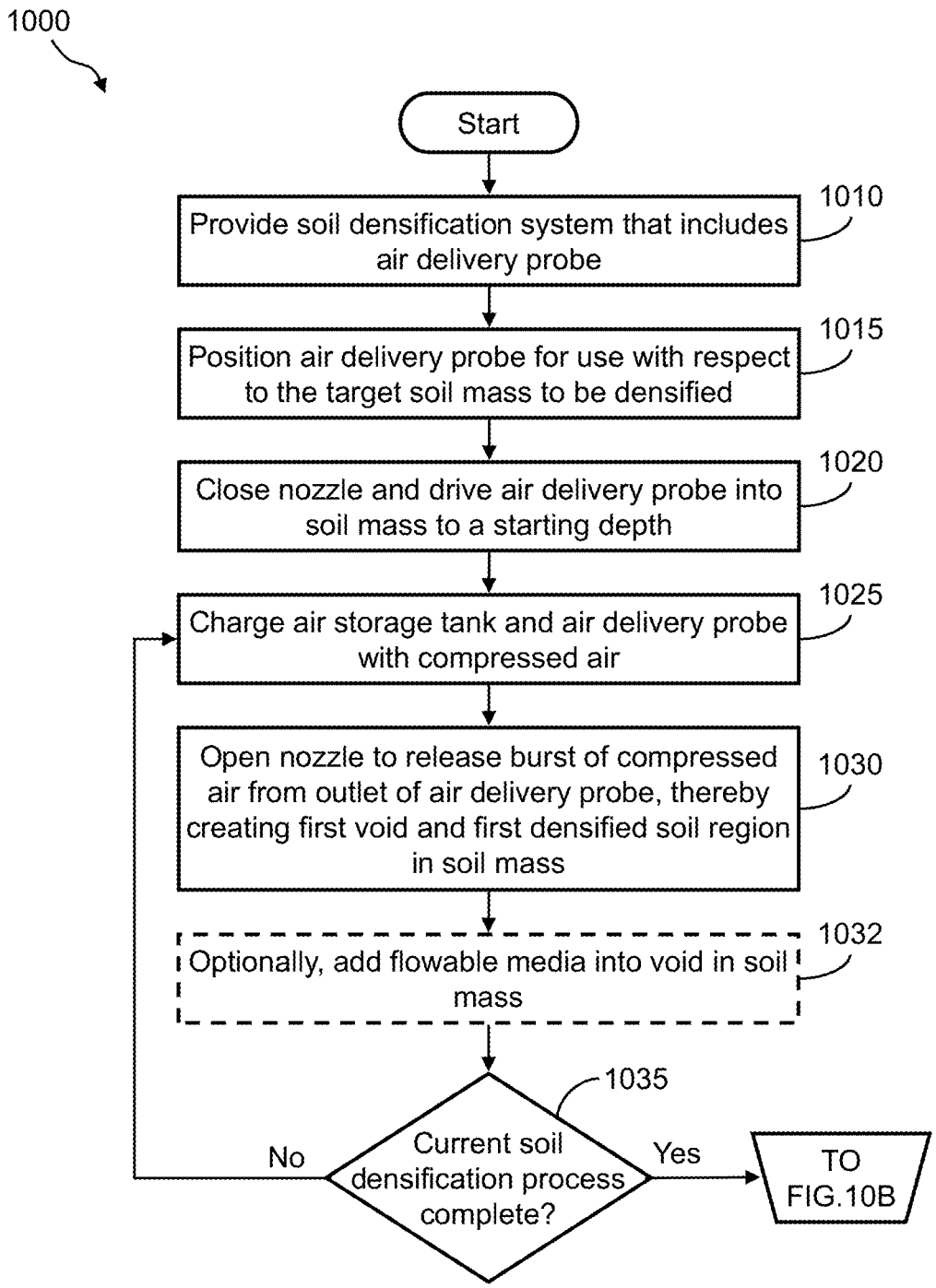
Figure 10B:
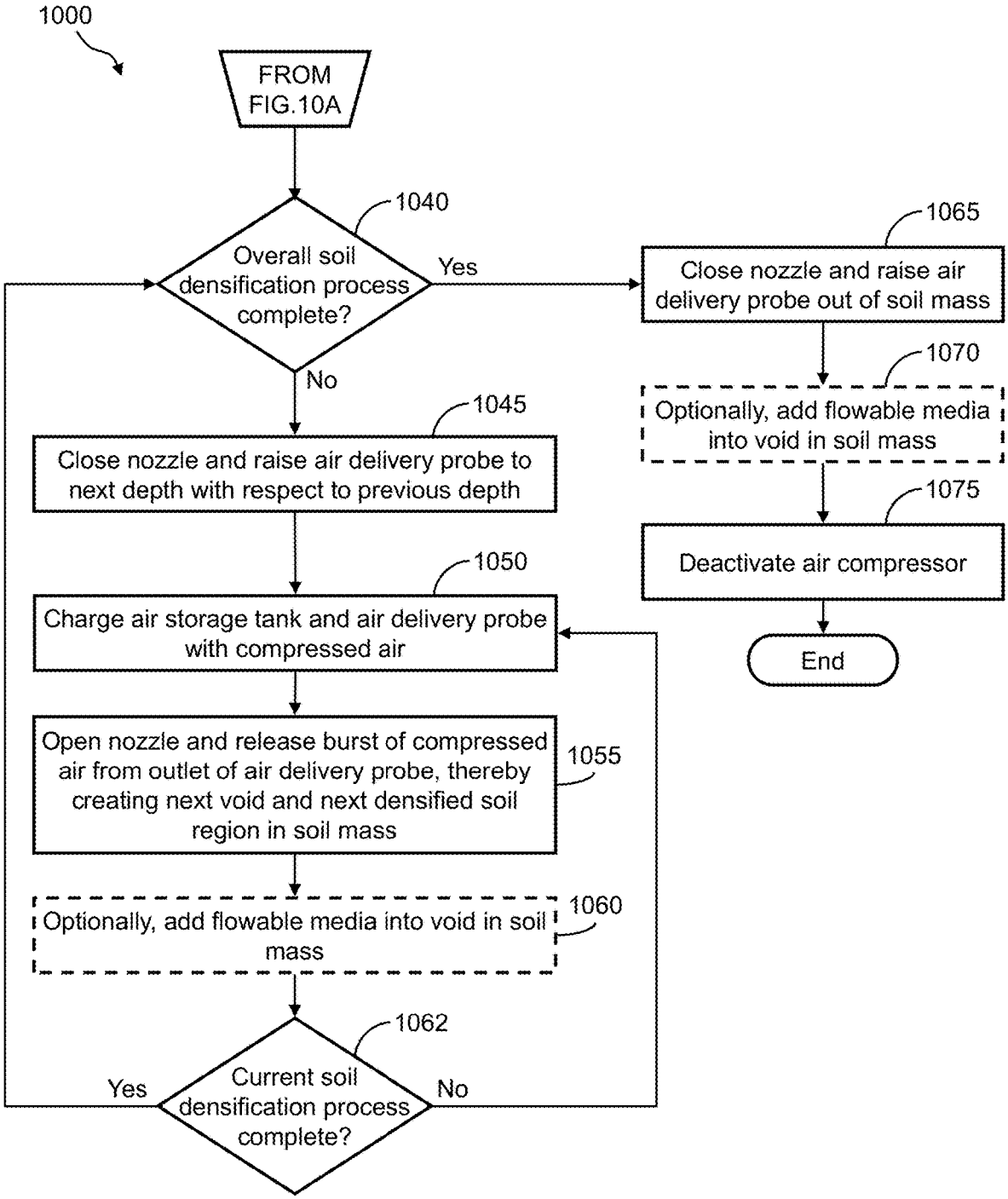
Figure 12:
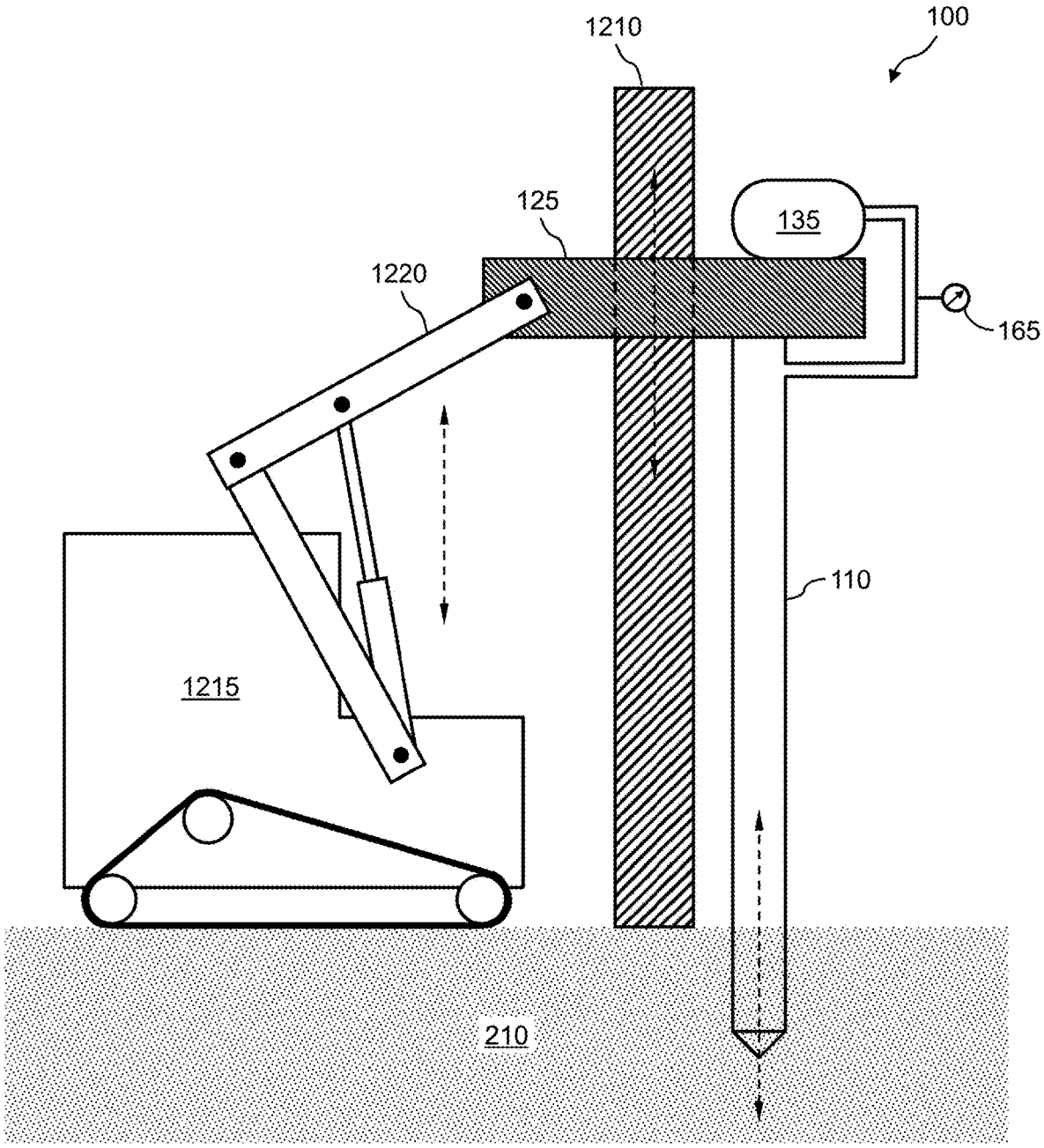
Figure 13:
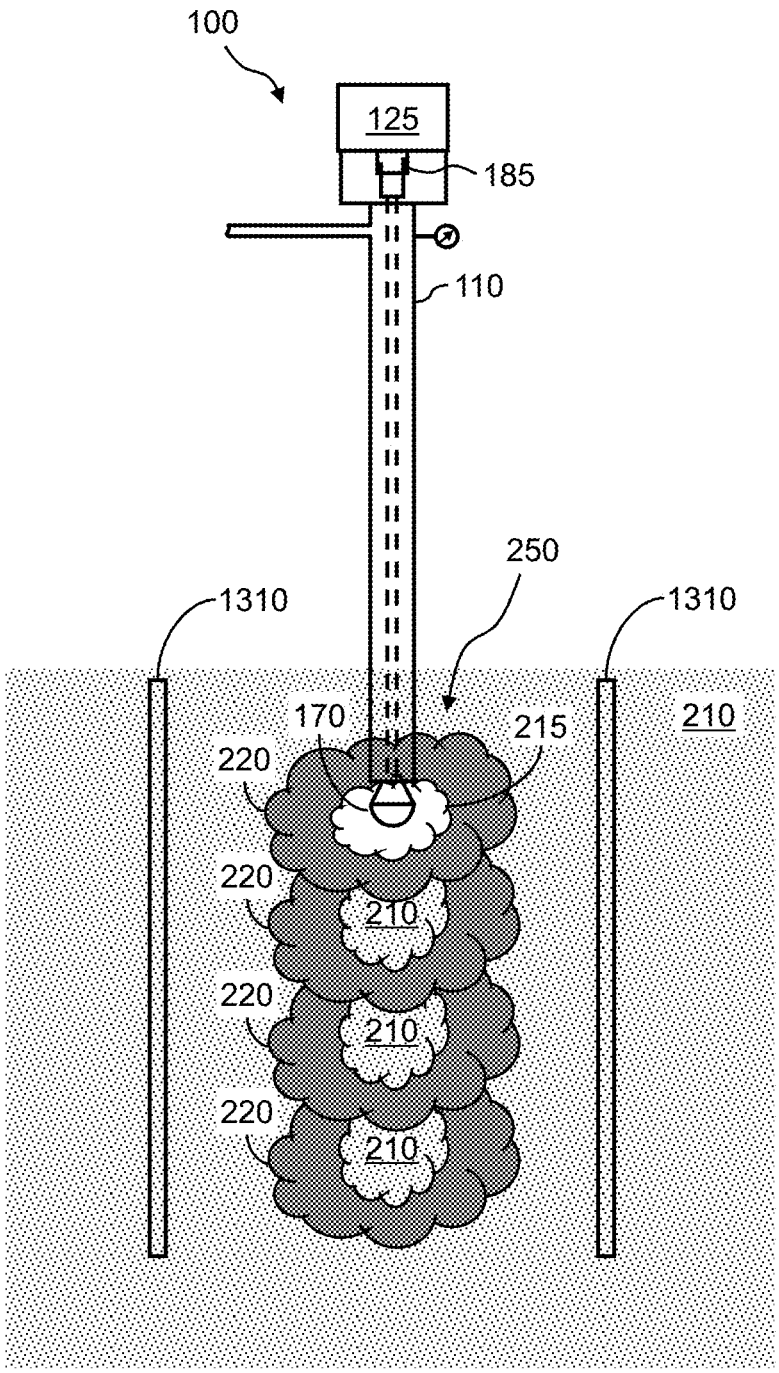

Having thus described the presently disclosed subject matter in general terms, reference will now be made to the accompanying Drawings, which are not necessarily drawn to scale, and wherein:

FIG. 1A and FIG. 1B illustrate schematic diagrams of examples of soil densification systems for controlled air soil densification;

FIG. 2A, FIG. 2B, and FIG. 2C show a process of using the soil densification system to densify a soil mass;

FIG. 3 illustrates a schematic diagram of an example of a soil densification system that includes a manifold for supplying compressed air to a plurality of air delivery probes at the same time or at staggered or sequential intervals;

FIG. 4A and FIG. 4B illustrate side views of the air delivery probe of the soil densification system and an example of a bulb-type nozzle for controlling the outlet thereof;

FIG. 5A and FIG. 5B illustrate side views, and FIG. 5C illustrates a cross-section view along line A-A of FIG. 5A, of the air delivery probe of the soil densification system and an example of a shutter mechanism for controlling multiple outlets thereof;

FIG. 6 illustrates a side view of an example of the air delivery probe of the soil densification system that includes multiple outlets arranged along its length;

FIG. 7A and FIG. 7B illustrate side views, and FIG. 7C illustrates a cross-section view along line A-A of FIG. 7A, of an example of the air delivery probe of the soil densification system that includes a secondary flow path in the form of a tube arranged outside of and concentrically with respect to the air delivery probe itself;

FIG. 8A and FIG. 8B illustrate a side view and a cross-section view along line A-A, respectively, of an example of the air delivery probe of the soil densification system that includes a secondary flow path in the form of a tube arranged alongside and outside of the air delivery probe itself;

FIG. 9A and FIG. 9B illustrate a side view and a cross-section view along line A-A, respectively, of an example of the air delivery probe of the soil densification system that includes a secondary flow path in the form of a tube arranged alongside and inside of the air delivery probe itself;

FIG. 10A and FIG. 10B illustrate a flow diagram of an example of a method of using the presently disclosed soil densification system to densify a soil mass using air impulses;

FIG. 11A through FIG. 11H illustrate a process of densifying a soil mass using the method shown in FIG. 10A and FIG. 10B;

FIG. 12 illustrates a side view of an example configuration of the soil densification system that uses a mast to support the air delivery probe and to guide its installation into the soil mass; and FIG. 13 illustrates a side view of an example configuration of the soil densification system in use with a prefabricated vertical drain system.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a soil densification system and method. The presently disclosed soil densification system includes an air delivery probe or pipe that can be driven or otherwise installed into a soil mass. An inlet at the proximal end of the air delivery probe is supplied by an air compressor and an air storage tank. The air compressor and air storage tank that supply the air delivery probe are used for the rapid delivery of air impulses or bursts into the air delivery probe, whereas the air impulses or bursts are expelled out of an outlet at the distal end of the air delivery probe and into the soil mass, thereby forming a densified region in the soil mass via the forces of the air impulse.

The method of using the presently disclosed soil densification system includes the steps of inserting the distal end of the air delivery probe into the soil mass to any desired depth and then releasing an impulse or burst of air into the soil mass. In so doing, the soil around the outlet of the air delivery probe is displaced away from the outlet. After displacement, the compressed soil exhibits an increased density compared to the soil density prior to the air impulse. The increase in density corresponds to an increase in soil strength and stiffness and a reduction in the potential for soil liquefaction. The void created by the air impulse may then be filled, for example, by the overlying soil collapsing into the void.

An aspect of the presently disclosed soil densification system and method is that it is used for forming a column of densified soil in the soil mass, wherein the column of densified soil reduces or substantially eliminates the potential for soil liquefaction.

Another aspect of the presently disclosed soil densification system and method is that it can be used at any soil depth, whereas, for example, conventional dynamic compaction methods are generally only efficient at improving the relative density of soil deposits less than 30 ft in depth.

Still another aspect of the presently disclosed soil densification system and method is that it is safe as compared with, for example, conventional explosive blasting methods.

Referring to FIG. 1A and FIG. 1B, there are schematic diagrams of two examples of a soil densification system 100 for controlled air soil densification. The soil densification system 100 comprises an air delivery probe 110. The air delivery probe 110 can be, for example, a steel pipe. The diameter of the air delivery probe 110 can be from about 0.5 inch (1.2 cm) to about 12 inches (30.5 cm). In one example, the diameter of the air delivery probe 110 is about 2 inches (5 cm). The wall thickness of the air delivery probe 110 can be from about 0.125 inches (0.32 cm) to about 1 inch (2.5 cm). In one example, the wall thickness of the air delivery probe 110 is about 0.25 inches (0.64 cm). The length of the air delivery probe 110 can be from about 3 ft (1 m) to about 130 ft (40 m). In one example, the length of the air delivery probe 110 is about 20 ft (6 m).

The air delivery probe 110 includes an inlet 115 at its proximal end and an outlet 120 at is distal end. The soil densification system 100 typically includes a force stage 125 mounted at the proximal end of air delivery probe 110. The force stage 125 is the mechanical interface between the air delivery probe 110 and machinery that is used for driving the air delivery probe 110 into the soil mass with downward force and for pulling the air delivery probe 110 out of the soil mass with upward force. The force stage 125 can be a platform or any strong mechanical structure suitable for performing this function. The design of the force stage 125 can vary depending on (1) the type of machinery used to drive and/or pull the air delivery probe 110, (2) the size of the air delivery probe 110, and (3) the amount of force needed to drive and/or pull the air delivery probe 110. The force stage 125 can be designed to be permanently affixed to the air delivery probe 110 or to be detachable.

The soil densification system 100 typically also includes an air compressor 130 that supplies an air storage tank 135, wherein the air storage tank 135 supplies the air delivery probe 110. More specifically, an outlet of the air compressor 130 is fluidly connected to an inlet of the air storage tank 135 via a first supply line 140. Further, an outlet of the air storage tank 135 is fluidly connected to the inlet 115 of the air delivery probe 110 via a second supply line 145. The first supply line 140 and the second supply line 145 can be flexible lines of any length of the type that are commonly used in compressed air systems.

The air compressor 130 can be any standard air compressor that is capable of providing pressurized air at from about 25 psi (0.17 MPa) to about 350 psi (2.4 MPa). The air compressor 130 is used to charge the air storage tank 135 and the air delivery probe 110 with pressurized air. In one example, the air storage tank 135 and the air delivery probe 110 are charged to about 125 psi (0.86 MPa) via the air compressor 130. The storage capacity of the air storage tank 135 must be at least substantially the same or greater than the storage capacity of the air delivery probe 110. In one example, an air delivery probe 110 that is 12 ft (3.6 m) long and 2 inches (5 cm) in diameter has a volume of about 1.9 gallons (7.2 liters). In another example, an air delivery probe 110 that is 30 ft (9.1 m) long and 2 inches (5 cm) in diameter has a volume of about 4.9 gallons (18.5 liters). In both cases, the storage capacity of the air storage tank 135 can be about 20 gallons (75.7 liters) in one example or about 30 gallons (113.5 liters) in another example.

A valve 150 is provided between the air storage tank 135 and the air delivery probe 110. Namely, the valve 150 is provided in the path along the second supply line 145. The valve 150 is used to allow or block the airflow from the air storage tank 135 to the air delivery probe 110. For example, the valve 150 is closed when the air delivery probe 110 is not in use and the valve 150 is opened when the air delivery probe 110 is in use. In one example, the valve 150 can be opened and closed manually. In another example, the valve 150 can be opened and closed under program control. In this case, the soil densification system 100 includes a controller 155. The soil densification system 100 also typically includes a pressure gauge 165 that is used to monitor the pressure inside of the air delivery probe 110.

The controller 155 can be any standard controller or microprocessor device that is capable of executing program instructions. For example, the controller 155 can be any computing device, such as, but not limited to, a laptop computer, a tablet computer, a mobile phone, a personal digital assistant (PDA), and the like. The controller 155 may be connected to the actuator of the valve 150 in any wired or wireless fashion.

In some embodiments, the outlet 120 of the air delivery probe 110 is simply the opening in the distal end of the air delivery probe 110, which is, for example, a steel pipe. However, in other embodiments, a nozzle 170 is provided at the outlet 120 of the air delivery probe 110. The function of the nozzle 170 is to prevent the air delivery probe 110 from filling with soil as it is being driven into or otherwise installed in the soil mass. A further purpose of the nozzle 170 is that it allows for the buildup of air pressure within the system and prevents the air from escaping prior to triggering.

In one example and referring now to FIG. 1A, the nozzle 170 is a one way flap mechanism that is in the closed position when the air delivery probe 110 is being driven into the soil mass. However, when in use, the flap-type of nozzle 170 can open away from the outlet 120 of the air delivery probe 110 by the force of the compressed air 160, thereby releasing the burst of compressed air 160 into the soil mass.

In another example, the nozzle 170 is a bulb mechanism that can be opened and close in a controlled manner against the edges of the outlet 120 of the air delivery probe 110. For example, FIG. 1B shows a bulb-type nozzle 170 for controlling the outlet of the air delivery probe 110. In this example, the bulb-type nozzle 170 is shaped to be snuggly fitted into the outlet 120 of the air delivery probe 110. Namely, the portion of the bulb-type nozzle 170 facing toward the outlet 120 is tapered while the portion of the bulb-type nozzle 170 facing away from the outlet 120 is rounded. In one example, the bulb-type nozzle 170 is formed of metal, such as steel. A rod 180, such as a steel rod, is provided inside the air delivery probe 110 that is used to mechanically couple the bulb-type nozzle 170 to an actuator 185 at the opposite end of the air delivery probe 110. More details of an example of the bulb-type nozzle 170 are shown and described herein below with reference to FIG. 4A and FIG. 4B.

In one example, the actuator 185 is a pneumatic actuator that is wired to a trigger device 190. When the actuator 185 is not activated the bulb-type nozzle 170 is in the retracted state. When the actuator 185 is activated the bulb-type nozzle 170 is in the extended state. Namely, the actuator 185 can be used to control the rapid delivery of air impulses or bursts out of the outlet 120 of the air delivery probe 110 and into the soil mass (not shown). In one example, the actuator 185 can be controlled manually using the trigger device 190. In another example, the actuator 185 can be controlled automatically using the controller 155.

Additionally, the air delivery probe 110 is not limited to one outlet only. In other embodiments of the soil densification system 100, the air delivery probe 110 can include multiple outlets. For example, multiple outlets can be provided along the length of the air delivery probe 110. More details of examples of air delivery probes 110 that include multiple outlets are shown and described herein below with reference to FIG. 5A, FIG. 5B, and FIG. 6.

In yet other embodiments of the soil densification system 100, a secondary flow path can be provided alongside the air delivery probe 110 for delivering a flowable media, such as, but not limited to, sand, gravel, concrete, and grout, into the void created by the burst of compressed air 160 into the soil mass. More details of example secondary flow paths running alongside the air delivery probe 110 are shown and described herein below with reference to FIG. 7A, FIG. 7B, FIG. 8A, and FIG. 9A.

In yet other embodiments of the soil densification system 100, the air compressor 130 and the air storage tank 135 are not limited to supplying one air delivery probe 110 only. The air compressor 130 and the air storage tank 135 of the soil densification system 100 can supply multiple air delivery probes 110. Air pressure bursts can be delivered simultaneously or in a staggered sequence depending on the actuation of the air release valves 150. More details of an example of the soil densification system 100 that includes multiple air delivery probes 110 is shown and described herein below with reference to FIG. 3.

FIG. 2A and FIG. 2B show the presently disclosed soil densification system 100 when in use. Namely, FIG. 2A, FIG. 2B, and FIG. 2C show a process of using the soil densification system 100 to densify a soil mass 210. In one example, the soil mass 210 is formed of loose sand deposit. The flap-type nozzle 170 is closed and the air storage tank 135 is charged with compressed air to a certain pressure. Then, the air delivery probe 110 is driven into or otherwise installed into the soil mass 210 to a certain depth. In one example, the outlet 120 or flap-type nozzle 170 of the air delivery probe 110 is about 12 ft (3.6 m) deep into the soil mass 210. Then and referring now to FIG. 2A, using the controller 155, the valve 150 is opened, thereby releasing a burst of compressed air 160 from the outlet 120 and into the surrounding soil mass 210. The duration of the burst of compressed air 160 can be from about 0.1 sec to about 5 sec. In one example, the duration of the burst of compressed air 160 is about 1 sec. Further, multiple bursts of compressed air 160 can be released in succession.

As a result of releasing one or more bursts of compressed air 160 into the soil mass 210, a void 215 is formed in a region of the soil mass 210 that is near the outlet 120 or flap-type nozzle 170 of the air delivery probe 110. Further, in the surrounded area around the void 215, the original volume of loose sand deposit is densified, thereby forming a densified region 220 in the soil mass 210. Namely, the soil around the outlet 120 of the air delivery probe 110 is displaced away from the outlet 120. After displacement, the compressed soil exhibits an increased density compared to the soil density prior to the air impulse. The increase in density corresponds to an increase in soil strength and stiffness, increase in soil density, and a reduction in the potential for compression and liquefaction.

Referring now to FIG. 2B, the air delivery probe 110 is pulled upward a certain distance with respect to the void 215. In so doing, the outlet 120 or flap-type nozzle 170 of the air delivery probe 110 is withdrawn from the void 215. The void 215 created by the air impulse may then be filled, for example, by the overlying soil mass 210 collapsing into the void 215 once or while the air delivery probe 110 is withdrawn, leaving behind the densified region 220 surrounding a pocket of loose soil mass material 210. The process shown in FIG. 2A and FIG. 2B can be repeated at different depths in order to form a column of densified soil in the soil mass 210. For example, FIG. 2C shows a densified soil column 250, which is an example of a column of densified soil that is the result of using the air delivery probe 110 at different specified depths in the soil mass 210. By way of example, the densified soil column 250 of FIG. 2C is formed by four bursts of compressed air 160 at four different depths. Multiple air bursts may be applied at each depth to increase the effectives of the process at each depth. More details of an example of a method of using the soil densification system 100 are shown and described herein below with reference to FIG. 10A, FIG. 10B, and FIG. 11A through FIG. 11H.

Using the soil densification system 100, the formation of a column of densified soil in the soil mass 210, such as the densified soil column 250, reduces the potential for compression and liquefaction.

Referring now to FIG. 3 is a schematic diagram of an example of the soil densification system 300 that includes a manifold for supplying compressed air to a plurality of air delivery probes 110 at the same time. In so doing, the soil densification system 300 allows multiple simultaneous treatment locations at once. Namely, the soil densification system 300 shown in FIG. 3 can support any number of air delivery probes 110 (i.e., air delivery probes 110-1 through **110-*n*). In the soil densification system 300, the air compressor 130 and the air storage tank 135 supply multiple air delivery probes 110 using a manifold 310. The manifold 310 includes an inlet 315 and multiple outlets 320 (i.e., outlets 320-1 through 320-*n*), wherein the number of outlets 320 corresponds to the number of air delivery probes 110**.

More specifically, the air compressor 130 and the air storage tank 135 supply the inlet 315 of manifold 310. Then, the outlet 320-1 supplies the inlet 115-1 of the air delivery probe 110-1, the outlet 320-2 supplies the inlet 115-2 of the air delivery probe 110-2, and so on through outlet **320-*n* and air delivery probe 110-*n***.

The specifications of the air compressor 130 and the storage capacity of the air storage tank 135 are tailored to handle the load of multiple air delivery probes 110. In other configurations of the soil densification system 300, each air delivery probe 110 has a dedicated air storage tank 135. Namely, the soil densification system 300 includes air storage tanks 135-1 through **135-*n*, all supplied by a common air compressor 130**.

Further, the soil densification system 300 can include a dedicated controller 155 (such as shown in FIG. 1A) or trigger device 190 (such as shown in FIG. 1B) for each of the air delivery probes 110 (e.g., controllers 155-1 through **155-*n* or trigger devices 190-1 through 190-*n*, not shown) or a single or common controller 155 or trigger device 190 for controlling all of the air delivery probes 110. The controller(s) 155 can control valves 150-1 through 150-*n*. The trigger device(s) 190 can control actuators 185-1 through 185-*n***. The trigger devices can control simultaneous, sequential, or staggered air burst discharges.

FIG. 4A and FIG. 4B show side views of the air delivery probe 110 of the soil densification system 100 and an example of a bulb-type nozzle 170 for controlling the outlet thereof. In this example, the bulb-type nozzle 170 is shaped to be snuggly fitted into the outlet 120 of the air delivery probe 110. The actuator 185 is a pneumatic actuator that is wired to the trigger device 190. The actuator 185 is arranged, for example, between the force stage 125 and a T-connector 425 that serves as the inlet 115 of the air delivery probe 110. Namely, the T-connector 425 can be used for connecting the air supply line, such as second supply line 145, to the air delivery probe 110.

FIG. 4A shows the actuator 185 when not activated and the bulb-type nozzle 170 in the retracted state. In this state, the bulb-type nozzle 170 is pulled back and fitted snuggly against the edges of the outlet 120 of the air delivery probe 110. In this state, the bulb-type nozzle 170 can be used to (1) block air from being released from the air delivery probe 110 and (2) block soil from entering the air delivery probe 110 during installation into the soil mass. By contrast, FIG. 4B shows the actuator 185 when activated and the bulb-type nozzle 170 in the extended state. In this state, the bulb-type nozzle 170 is pushed outward and away from the edges of the outlet 120 of the air delivery probe 110. In this state, compressed air is allowed to be released from the end of the air delivery probe 110 and into the soil mass. The trigger device 190 of the actuator 185 can be controlled manually or via the controller 155.

The air delivery probe 110 is not limited to one outlet only. FIG. 5A, FIG. 5B, and FIG. 6 show embodiments of the soil densification system 100 wherein the air delivery probe 110 includes multiple outlets. Referring to FIG. 5A and FIG. 5B, there is one example of an air delivery probe 110 that includes multiple outlets. Namely, FIG. 5A and FIG. 5B show side views of the air delivery probe 110 of the soil densification system 100 and an example of a shutter mechanism 510 for controlling multiple outlets thereof. In this example, a plurality of outlets 120 is arranged on the sides and along the length of the air delivery probe 110, instead of at the distal end of the air delivery probe 110. In particular, the end of the air delivery probe 110 is sealed with a plate 525. The shutter mechanism 510 is a hollow pipe or sleeve that is slidably fitted inside of the air delivery probe 110. For example, the shutter mechanism 510 is coupled to the actuator 185 (that is described in FIG. 4A and FIG. 4B) via a rod 515, such as a steel rod. The shutter mechanism 510 includes a set of openings 520 that are in the pattern of the outlets 120 in the air delivery probe 110.

Using the actuator 185, the shutter mechanism 510 can be used to either block the outlets 120 in the air delivery probe 110 or open the outlets 120 in the air delivery probe 110. For example, FIG. 5A shows the actuator 185 when not activated and the shutter mechanism 510 in the closed state. In this state, the openings 520 of the shutter mechanism 510 are not aligned with the outlets 120 in the air delivery probe 110. In this state, the shutter mechanism 510 can be used to (1) block air from being released from the air delivery probe 110 and (2) block soil from entering the air delivery probe 110 during installation into the soil mass. By contrast, FIG. 5B shows the actuator 185 when activated and the shutter mechanism 510 in the opened state. In this state, the openings 520 of the shutter mechanism 510 are substantially aligned with the outlets 120 in the air delivery probe 110. In this state, compressed air is allowed to be released from the sides of the air delivery probe 110 and into the soil mass. Again, the trigger device 190 of the actuator 185 can be controlled manually or via the controller 155.

Referring now to FIG. 6 is another example of multiple outlets in the air delivery probe 110. Namely, FIG. 6 shows a side view of an example air delivery probe 110 of the soil densification system 100 that includes multiple outlets 120 arranged along its length and without any features controlling to opening or closing of the outlets 120. In this example, a plurality of outlets 120 is arranged on the sides and along the length of the air delivery probe 110 in any patterns, numbers, and spacing.

Using the air delivery probe 110 shown in FIG. 5A and FIG. 5B, or FIG. 6, multiple outlets 120 allow for the air impulse to be delivered at multiple elevations along the depth (length) of the air delivery probe 110 at one time.

Other embodiments of the soil densification system 100 can include a secondary flow path in combination with the air delivery probe 110, which is the primary air flow path. A secondary flow path may be useful for delivering a flowable media, such as, but not limited to, sand, gravel, concrete, and grout, into the void created by the burst of compressed air 160 into the soil mass. For example and referring now again to FIG. 2A and FIG. 2B, a secondary flow path may be useful for delivering a flowable media into the void 215 in the soil mass 210, which is created by the burst of compressed air 160 into the soil mass 210.

Referring to FIG. 7A and FIG. 7B, there is one example of a secondary flow path in combination with the air delivery probe 110. Namely, FIG. 7A and FIG. 7B show side views of an example air delivery probe 110 of the soil densification system 100 that includes a secondary flow path in the form of a pipe or tube 710. The pipe or tube 710 can be, for example, a steel pipe. Air delivery probe 110 itself is arranged inside of (or internal to) and concentric with pipe or tube 710. In one example, if the diameter of the air delivery probe 110 is about 2 inches (5 cm), then the diameter of the pipe or tube 710 can be, for example, about 6 inches (about 15 cm). In this example, the air delivery probe 110 is substantially centered within the pipe or tube 710. That is, the offset between the air delivery probe 110 and the pipe or tube 710 is substantially constant.

In this example, the pipe or tube 710 has an inlet 715, which is near the proximal end of the air delivery probe 110, and an outlet 720, which is near the distal end (i.e., outlet 120) of the air delivery probe 110. Further, a sacrificial plate 725 can be provided at the outlet 720 of the pipe or tube 710. The sacrificial plate 725 has an opening in the center that allows clearance, in this example, for the bulb-type of nozzle 170. Once driven into the soil mass, the sacrificial plate 725 will release by the force of the compressed air 160 and/or the force of the flowable media within the pipe or tube 710 as the air delivery probe 110 is raised. Consequently, the sacrificial plate 725 will be left at the bottom of the densified soil column. In so doing, the outlet 720 of the pipe or tube 710 is opened up and ready for use.

In operation and referring now to FIG. 2, FIG. 7A, and FIG. 7B, once the burst of compressed air 160 has been delivered and the void 215 is formed in the soil mass 210, flowable media is poured or otherwise flowed into the inlet 715 by any means. Then, the flowable media flows through the pipe or tube 710 (outside of the air delivery probe 110 itself). Then, the flowable media exits the outlet 720 of the pipe or tube 710 and flows into the void 215 in the soil mass 210.

Referring now to FIG. 8A is another example of a secondary flow path in combination with the air delivery probe 110. Namely, FIG. 8A shows a side view of an example air delivery probe 110 of the soil densification system 100 that includes a secondary flow path in the form of a pipe or tube 810 arranged outside of (or external to) and alongside the air delivery probe 110 itself. The pipe or tube 810 can be, for example, a steel pipe. In one example, if the diameter of the air delivery probe 110 is about 2 inches (5 cm), then the diameter of the pipe or tube 810 can be, for example, about 4 inches (about 10 cm).

In this example, the pipe or tube 810 has an inlet 815, which is near the proximal end of the air delivery probe 110, and an outlet 820, which is near the distal end (i.e., outlet 120) of the air delivery probe 110. In operation and referring now to FIG. 2 and FIG. 8A, once the burst of compressed air 160 has been delivered and the void 215 is formed in the soil mass 210, flowable media is poured or otherwise flowed into the inlet 815 by any means. Then, the flowable media flows through the pipe or tube 810. Then, the flowable media exits the outlet 820 of the pipe or tube 810 and flows into the void 215 in the soil mass 210.

Referring now to FIG. 9A is yet another example of a secondary flow path in combination with the air delivery probe 110. Namely, FIG. 9A shows a side view of an example air delivery probe 110 of the soil densification system 100 that includes a secondary flow path in the form of a pipe or tube 910. The pipe or tube 910 can be, for example, a steel pipe. Air delivery probe 110 itself is arranged inside of (or internal to) and alongside the pipe or tube 910. In one example, if the diameter of the air delivery probe 110 is about 2 inches (5 cm), then the diameter of the pipe or tube 910 can be, for example, about 4 inches (about 10 cm). In this example, the air delivery probe 110 is positioned inside of and to one side of the pipe or tube 910. That is, the offset between the air delivery probe 110 and the pipe or tube 910 varies, i.e., the offset is not constant.

In this example, the pipe or tube 910 has an inlet 915, which is near the proximal end of the air delivery probe 110, and an outlet 920, which is near the distal end (i.e., outlet 120) of the air delivery probe 110. In operation and referring now to FIG. 2 and FIG. 9A, once the burst of compressed air 160 has been delivered and the void 215 is formed in the soil mass 210, flowable media is poured or otherwise flowed into the inlet 915 by any means. Then, the flowable media flows through the pipe or tube 910. Then, the flowable media exits the outlet 920 of the pipe or tube 910 and flows into the void 215 in the soil mass 210.

FIG. 10 illustrates a flow diagram of an example of a method 1000 of using the presently disclosed soil densification system 100 to densify a soil mass using air impulses. Using the soil densification system 100 and method 1000, the formation of a column of densified soil in the soil mass 210, such as the densified soil column 250, reduces the potential for compression and liquefaction.

In the method 1000, the air delivery probe 110 includes the bulb-type nozzle 170 shown in FIG. 4A and FIG. 4B for controlling the outlet thereof. However, this is exemplary only. In the method 1000, any type of outlet control as described herein above may be used. The method 1000 may include, but is not limited to, the following steps.

At a step 1010, the soil densification system 100 that includes the air delivery probe 110 is provided at the site of the soil mass to be densified using air impulses. For example and referring to FIG. 2A and FIG. 2B, the soil densification system 100 is delivered to the site of the soil mass 210, which is the target soil mass to be densified using air impulses.

At a step 1015, the air delivery probe 110 is positioned for use with respect to the target soil mass to be densified. For example and referring to FIG. 2A and FIG. 2B, the outlet 120-end (i.e., the bulb-type nozzle 170) of the air delivery probe 110 is placed on the surface of the soil mass 210. Then, the inlet 115-end of the air delivery probe 110 is lifted such that the air delivery probe 110 is positioned substantially orthogonal (or at some desired angle) with respect to the plane of the surface of the soil mass 210.

At a step 1020, using the actuator 185, the bulb-type nozzle 170 is closed. In one example, the actuator 185 is closed manually using the trigger device 190. In another example, the actuator 185 is closed using the controller 155. Using the force stage 125, the air delivery probe 110 is driven or otherwise installed into the soil mass 210 to a starting depth. In one example, the outlet 120-end (i.e., the bulb-type nozzle 170) of the air delivery probe 110 is driven into the soil mass 210 to a starting depth of about 20 ft (6 m).

At a step 1025, or concurrently with step 1020, the air compressor 130 is activated (i.e., turned on) and the air storage tank 135 and air delivery probe 110 are charged to a certain pressure, such as to about 125 psi. The pressure gauge 165 can be used to verify that the desired pressure has been reached. In one example, the pressure gauge 165 is monitored manually and the air compressor 130 is operated manually. In another example, the pressure gauge 165 is monitored by the controller 155 and the air compressor 130 is operated via the controller 155.

At a step 1030, using the actuator 185, the bulb-type nozzle 170 is opened to release an impulse of compressed air 160 from the outlet 120 of the delivery probe 110 and into the soil mass 210. In one example, the actuator 185 is opened manually using the trigger device 190. In another example, the actuator 185 is opened using the controller 155. In so doing and referring again to FIG. 2A and FIG. 2B, the first void 215 and the first densified region 220 are formed in the soil mass 210.

At an optional step 1032, flowable media is added into the void 215 that is formed in the soil mass 210. For example, using a secondary flow path, such as the pipe or tube 710 shown in FIG. 7A and FIG. 7B, the pipe or tube 810 shown in FIG. 8A, or the pipe or tube 910 shown in FIG. 9A, a flowable media, such as, but not limited to, sand, gravel, concrete, and grout, is added into the void 215 in the soil mass 210.

At a decision step 1035, it is determined whether the soil densification process is complete at the current discharge elevation. If yes, then the method 1000 proceeds to a step 1040. However, if no, then the method 1000 returns to the step 1025, wherein steps 1025 through 1032 may be repeated until the densification process at a given elevation is completed.

At a decision step 1040, it is determined whether the overall soil densification process for a column of soil is complete. Namely, it is determined whether the column of densified soil is formed along the full path from the initial depth D of the air delivery probe 110 to the surface of the soil mass 210. If no, then the method 1000 proceeds to a step 1045. However, if yes, then the method 1000 proceeds to a step 1065.

At the step 1045, using the actuator 185, the bulb-type nozzle 170 is closed. In one example, the actuator 185 is closed manually using the trigger device 190. In another example, the actuator 185 is closed using the controller 155. Then, using the force stage 125, the air delivery probe 110 is raised to the next depth with respect to the previous depth, whereby withdrawal of the air delivery probe 110 causes the void 215 to backfill with soil (e.g., loose sand) from the soil mass 210. In one example, the air delivery probe 110 is raised 5 ft (1.5 m) with respect to the previous depth.

At a step 1050, using the air compressor 130, the air storage tank 135 and the air delivery probe 110 are charged to a certain pressure, such as to about 125 psi. The pressure gauge 165 can be used to verify that the desired pressure has been reached. In one example, the pressure gauge 165 is monitored manually and the air compressor 130 is operated manually. In another example, the pressure gauge 165 is monitored by the controller 155.

At a step 1055, using the actuator 185, the bulb-type nozzle 170 is opened to release an impulse of compressed air 160 from the outlet 120 of the delivery probe 110 and into the soil mass 210. In one example, the actuator 185 is opened manually using the trigger device 190. In another example, the actuator 185 is opened using the controller 155. In so doing and referring again to FIG. 2A and FIG. 2B, the next void 215 and the next densified region 220 are formed in the soil mass 210.

At an optional step 1060, flowable media is added into the void 215 that is formed in the soil mass 210. For example, using a secondary flow path, such as the pipe or tube 710 shown in FIG. 7A and FIG. 7B, the pipe or tube 810 shown in FIG. 8A, or the pipe or tube 910 shown in FIG. 9A, a flowable media, such as, but not limited to, sand, gravel, concrete, and grout, is added into the void 215 in the soil mass 210.

At a decision step 1062, it is determined whether the soil densification process is complete at the current discharge elevation. If yes, then the method 1000 returns to the step 1040. However, if no, then the method 1000 returns to the step 1050, wherein steps 1050 through 1060 may be repeated until the densification process at a given elevation is completed.

At the step 1065, using the actuator 185, the bulb-type nozzle 170 is closed. Then, using the force stage 125, the air delivery probe 110 is raised out of the soil mass 210, whereby withdrawal of the air delivery probe 110 causes the void 215 to backfill with soil (e.g., loose sand) from the soil mass 210.

At an optional step 1070, flowable media is added into the void 215 that is formed in the soil mass 210. For example, using a secondary flow path, such as the pipe or tube 710 shown in FIG. 7A and FIG. 7B, the pipe or tube 810 shown in FIG. 8A, or the pipe or tube 910 shown in FIG. 9A, a flowable media, such as, but not limited to, sand, gravel, concrete, and grout, is added into the void 215 in the soil mass 210.

At a step 1075, the air compressor 130 is deactivated (i.e., turned off) either manually or via the controller 155. The method 1000 ends.

FIG. 11A through FIG. 11H illustrate a process of densifying a soil mass using the method 1000 shown in FIG. 10. For example, FIG. 11A through FIG. 11H illustrate a process of using the method 1000 to form the densified soil column 250 shown in FIG. 2C.

Figures 11A, 11B:
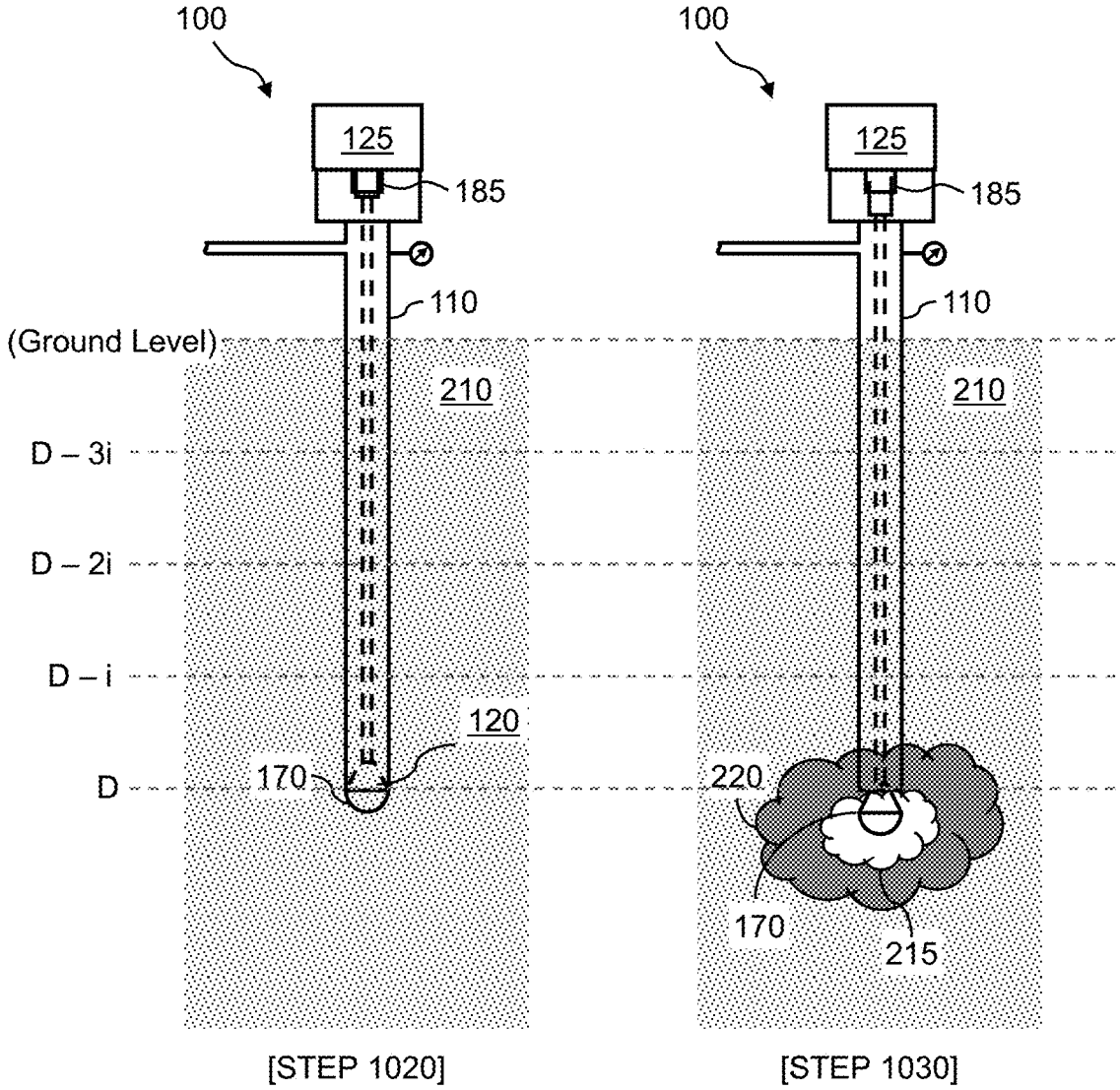

Referring now to FIG. 11A is an illustration of the step 1020 of the method 1000, wherein the air delivery probe 110 is driven or otherwise installed into the soil mass 210 to a starting depth D. In one example, the starting depth D is about 20 ft (6 m). Referring now to FIG. 11B is an illustration of the step 1030 of the method 1000, wherein the first burst of compressed air 160 is released from the outlet 120 of the air delivery probe 110 (when outlet valve 170 is opened) and into soil mass 210. In so doing, the first void 215 and the first densified region 220 are formed in the soil mass 210 at the starting depth D.

Figures 11C, 11D:
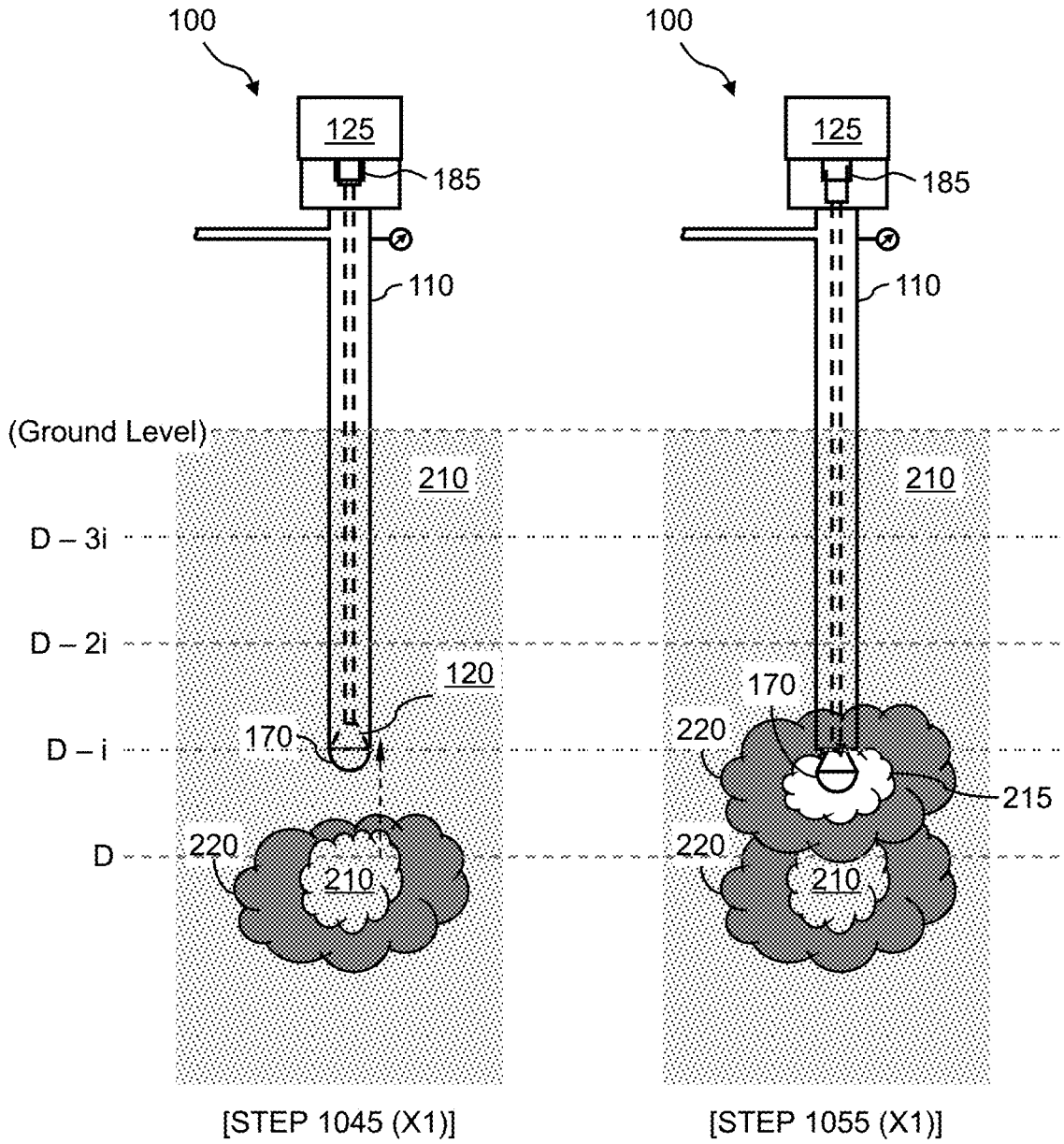

Referring now to FIG. 11C is an illustration of the step 1045 of the method 1000, wherein the air delivery probe 110 is raised to the next depth with respect to the starting depth D. For example, if it is planned to form densified regions 220 every 5 ft in the path from depth D to the surface of the soil mass 210, then the air delivery probe 110 is moved in 5 ft-increments (i). Accordingly, FIG. 11C shows the air delivery probe 110 is raised from starting depth D to a depth D−i, which is, for example, 20 ft−5 ft=15 ft.

Referring now to FIG. 11D is an illustration of the step 1055 of the method 1000, wherein the next burst of compressed air 160 is released from the outlet 120 of the air delivery probe 110 and into soil mass 210. In so doing, the next void 215 and the next densified region 220 are formed in the soil mass 210 at the depth D−i, which is, for example, at the depth of 15 ft.

Figures 11E, 11F:
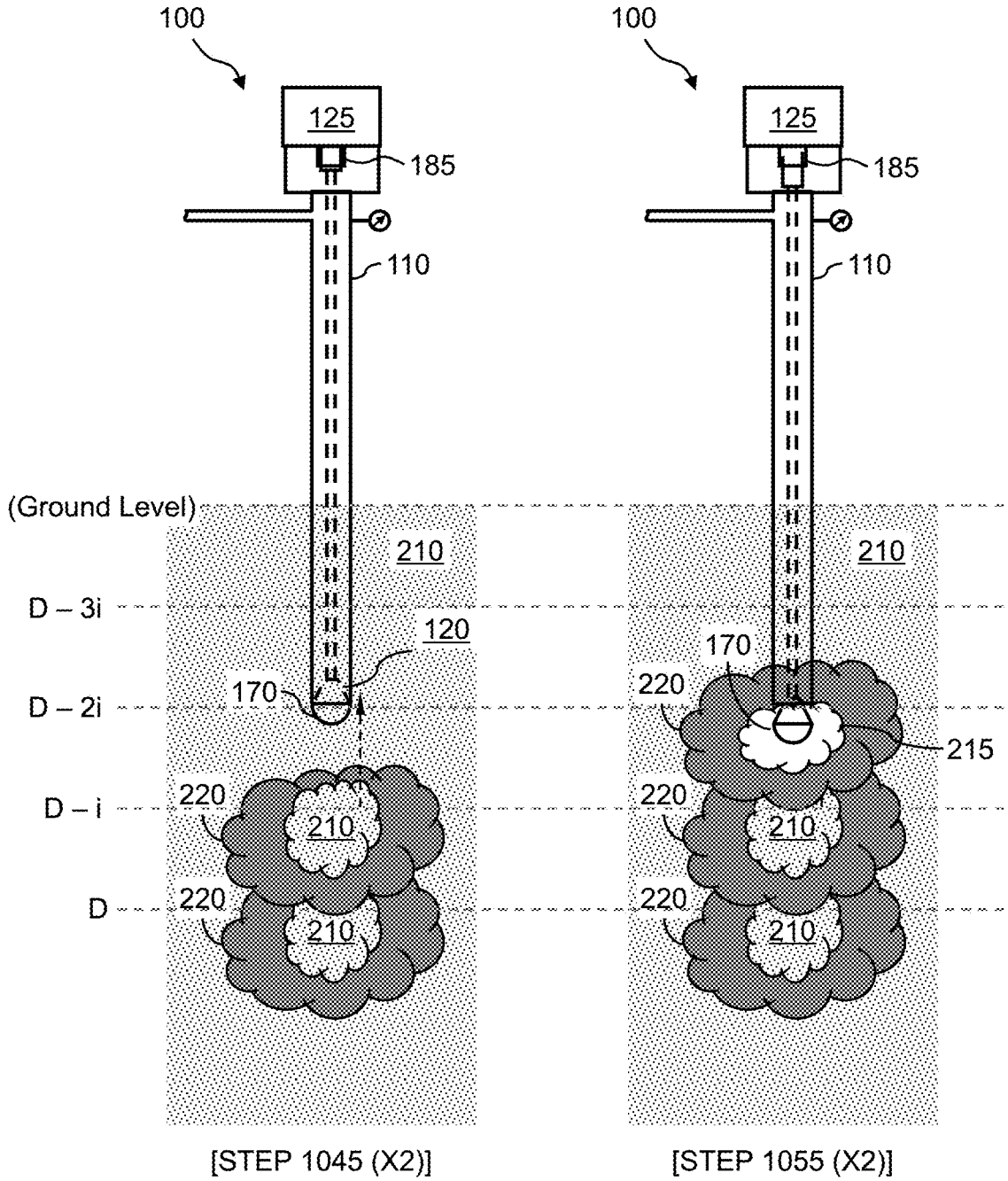

Referring now to FIG. 11E is an illustration of the step 1045 of the method 1000, which is repeated now a second time, wherein the air delivery probe 110 is raised to the next depth with respect to the previous depth D−i. Continuing the example, FIG. 11E shows the air delivery probe 110 is raised from depth D−i to a depth D−2i, which is, for example, 20 ft−(2×5 ft)=10 ft.

Referring now to FIG. 11F is an illustration of the step 1055 of the method 1000, which is repeated now a second time, wherein the next burst of compressed air 160 is released from the outlet 120 of the air delivery probe 110 and into soil mass 210. In so doing, the next void 215 and the next densified region 220 are formed in the soil mass 210 at the depth D−2i, which is, for example, at the depth of 10 ft.

Figure 11G:
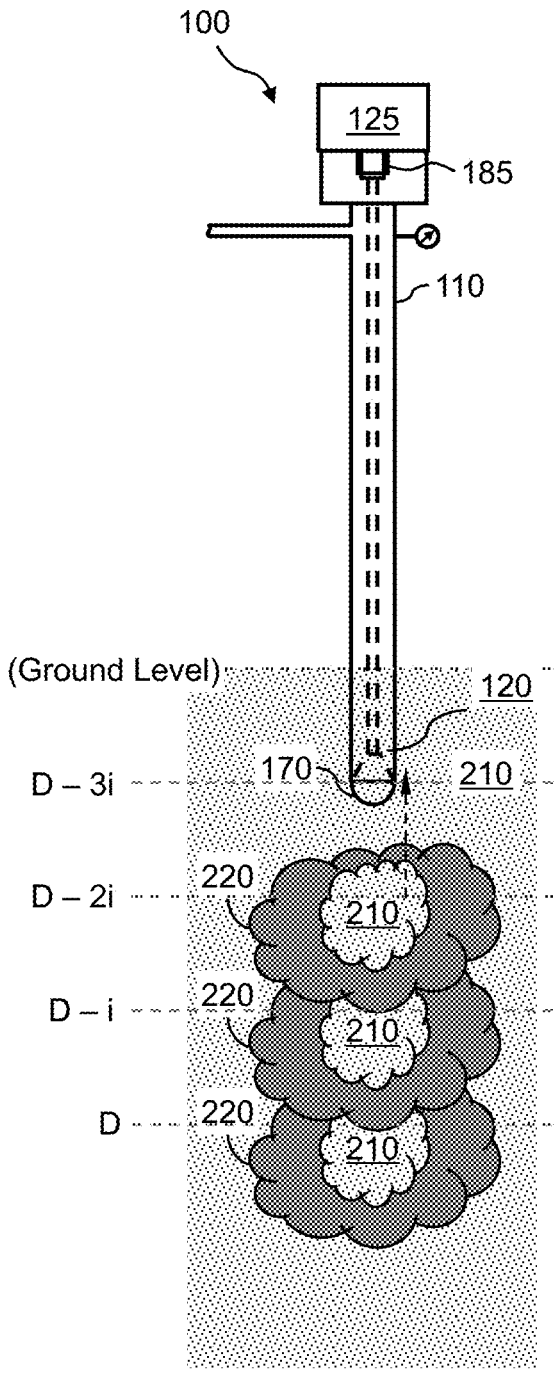

Referring now to FIG. 11G is an illustration of the step 1045 of the method 1000, which is repeated now a third time, wherein the air delivery probe 110 is raised to the next depth with respect to the previous depth D−2i. Continuing the example, FIG. 11G shows the air delivery probe 110 is raised from depth D−2i to a depth D−3i, which is, for example, 20 ft−(3×5 ft)=5 ft.

Figure 11H:
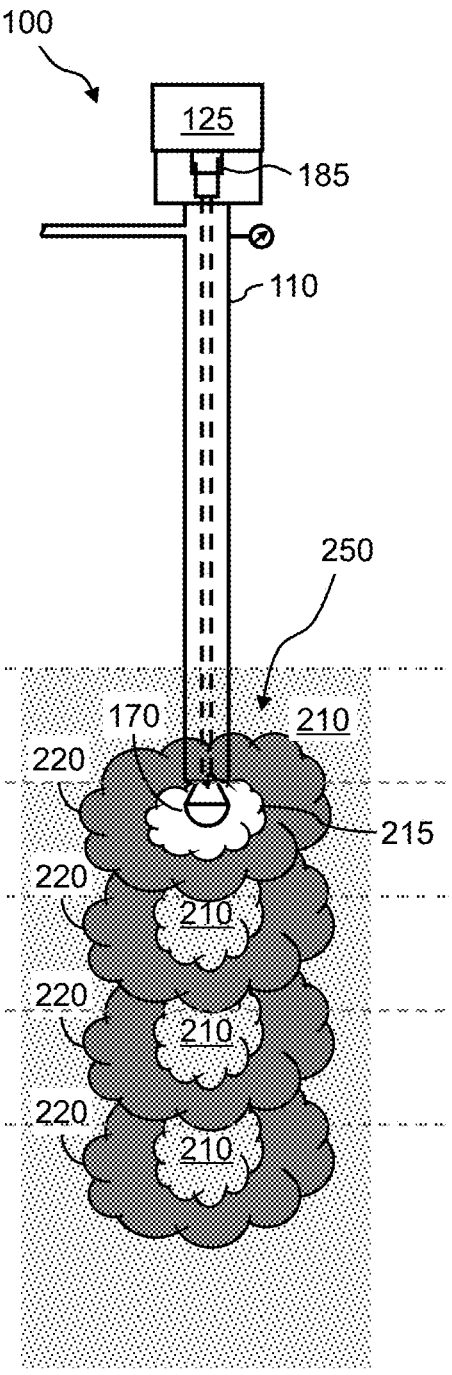

Referring now to FIG. 11H is an illustration of the step 1055 of the method 1000, which is repeated now a third time, wherein the next burst of compressed air 160 is released from the outlet 120 of the air delivery probe 110 and into soil mass 210. In so doing, the next void 215 and the next densified region 220 are formed in the soil mass 210 at the depth D−3i, which is, for example, at the depth of 5 ft.

Referring now again to FIG. 2C is an illustration of the step 1065 of the method 1000, wherein the air delivery probe 110 is raised out of the soil mass 210 because the densified soil column 250 is completed.

In FIG. 1 through FIG. 11H, the air compressor 130 and the air storage tank 135 can be, for example, in a stationary position on the ground. The air lines (e.g., first supply line 140 and/or second supply line 145) connecting the air storage tank 135 to the air delivery probe 110 can be long flexible lines so that the air delivery probe 110 can be manipulated separately from the air compressor 130 and the air storage tank 135. This configuration of the soil densification system 100 allows the air delivery probe 110 to be driven or otherwise installed into the soil mass 210 at a position away from the air compressor 130 and the air storage tank 135. However, other configurations of the soil densification system 100 are possible. An example of another configuration of the soil densification system 100 is shown herein below with reference to FIG. 12.

Referring now to FIG. 12 is a side view of an example configuration of the soil densification system 100 that uses a mast 1210 to support the air delivery probe 110 and to guide its installation into the soil mass 210. For example, the mast 1210 can be an I-beam. In this example, the force stage 125 is designed to (1) provide the mechanism for coupling downward or upward force to the air delivery probe 110, as previously described; (2) be slidably coupled to the mast 1210; and (3) provide a platform for holding the air storage tank 135.

In this example, the mast 1210 may include a track or rail system (not shown) that allows the force stage 125 to slide up and down (when in use) along the mast 1210, wherein the air storage tank 135 moves up and down with the force stage 125. The force stage 125 may be raised and lowered with a hydraulic piston with a chain drive, or with a cable and winch system. Additionally, FIG. 12 shows heavy equipment 1215 whose arms 1220 are mechanically coupled to the end of the force stage 125 that is opposite the air delivery probe 110. The heavy equipment 1215 can be, for example, any type of excavator base (i.e., Caterpillar 330 base machine) loader that is capable of providing the forces needed to the force stage 125 for driving or otherwise installing the air delivery probe 110 into the soil mass 210.

In this configuration of the soil densification system 100, the air compressor 130 (not shown) can be in a stationary position on the ground. However, in another embodiment, both the air compressor 130 and the air storage tank 135 can be mounted on the force stage 125, wherein both the air compressor 130 and the air storage tank 135 move up and down along the mast 1210 with the force stage 125. In yet another embodiment, both the air compressor 130 and the air storage tank 135 can be in a stationary position on the ground. In yet another embodiment, the air compressor 130 and air storage tank 135 can be mounted on the heavy equipment 1215.

Referring now to FIG. 13 is an illustration of the present invention when used in conjunction with a prefabricated vertical drain (PVD) system. The PVD system can be comprised of PVD elements 1310 that are installed prior to densification. The PVD elements 1310 allow for rapid egress of water from the soil mass during densification.

EXAMPLES

Example 1

In one example of the invention, the method of densifying granular soils with air impulses was demonstrated in a bench-scale test. The bench-scale test was conducted by first placing loose sand in a 55 gallon cylindrical drum. The loose deposit of sand was created by partially filling the drum with water, placing a screen over the top of the drum, and passing sand through the screen into the water. The sand settled through the water into a loose configuration.

Once the sand was placed in the drum, excess water was removed from the drum to expose the surface of the sand. The sand surface, relative to the top of the drum, was measured at multiple locations. A ½-inch diameter probe (or tube) was then inserted into the sand such that the tip of the probe was approximately at the midpoint between the top of the sand and the bottom of the drum. After the probe was inserted, an air impulse of 110 pounds per square inch was delivered. After the impulse was delivered, the sand surface profile relative to the top of the steel drum was measured.

The increase in relative density can be calculated by comparing the volume of sand prior to the air impulse to the volume of sand after the impulse. In this example, after the post densification volume of sand was measured, the drum was emptied and the process was repeated. A total of ten (10) trials were conducted. On average, the relative density of the sand within the drum increased from 6.2% prior to the air impulse to 54% after the air impulse.

Example 2

In another example of the invention, the method of densifying granular soils with air impulses was demonstrated in full scale field test. The field test was conducted at a site that was characterized by subsurface materials consisting of unsaturated medium dense silt and silty sand materials. These materials are well known to those skilled in the art as materials that cannot be densified using shaking or other vibratory means. For this reason, 36-inch diameter holes were drilled into the ground and backfilled with loose sand that was then densified using the invention as described above.

Four 36-inch diameter test holes were drilled. Two of the test holes were 5 feet deep and two of the test holes were 12 feet deep. After drilling, 36-inch outside diameter steel casings were lowered into the holes. The holes were then filled with 1 to 2 inches of grout to form a seal at the bottom of the holes. The purpose of the casings and the grout was to form a water tight seal around the sand backfill to ensure that the sand was saturated during testing.

After placing the grout, the casings were filled with water to a depth equal to one-half of the casing height. Then, clean sand (less than 3% passing the No. 200 sieve) was pluviated into the casing. This was accomplished by placing a screen with ¼-inch wide openings over the top of the casing, pouring sand through the screen, and vibrating the screen so that the sand "rained" into the casing. The sand was placed in this manner to the top of the casing. Because the water in the casing could not escape from the casing, the water level in the casing rose upward as the sand was placed. Water escaped over the top of the casing at the end of the pluviation showing that the sand was saturated prior to being treated by the present invention.

A 2-inch diameter pipe was then lowered through the center of the sand column to a depth of 3 feet for the 5-foot long casing and to a depth of 9 feet for the 12-foot long casing. The pipe was equipped with a nozzle and a valve at the bottom of the pipe. The pipe had a 2 gallon storage capacity. The pipe was connected to two air storage tanks. One of the tanks had a storage capacity of 30 gallons and the other tank had a storage capacity of 20 gallons. After inserting the pipe into the sand, the storage tanks that were connected to the pipe were charged with air pressurized to 125 psi.

The pressurized air that was stored in the pipe and the storage tanks was then released. The air pressure was released by using a trigger to engage a pneumatic piston to open the nozzle at the bottom of the pipe.

For the first test, performed within a 12-foot long casing, the pressurized air from the pipe and both storage tanks (total storage capacity of 52 gallons) was released in a short time increment of less than 1 second. This resulted in a system pressure drop of 25 psi to achieve an end-of-test system pressure of 100 psi at the end of the release. The air release at the single injection location resulted in a top-of-casing sand elevation drop of 2.9 inches. The volume occupied by the sand within the casing thus decreased from 75.2 cubic feet to 73.6 cubic feet (2.1% volumetric strain).

The second test was also performed within a 12-foot long casing using the pressurized air volume from the pipe and from the 20-gallon storage tank. The entire volume (22 gallons) of pressurized air was released in a single dose lasting many seconds. The second test resulted in an eruption of sand out of the casing onto the ground surface. Although the second test did not allow for the measurement of volumetric strain, it did show that short bursts of air pressurized to 125 psi are sufficient to dynamically translate particles of saturated sand.

The third test was performed within a 5-foot long casing using a single short-duration burst of air. The short duration lasted less than 1 second. Similar to Test 2, the third test released air from the pipe and from the 20-gallon tank. As for Test 2, the release of the pressurized air resulted in an eruption of sand out of the casing onto the ground surface.

The fourth test was also performed within a 5-foot long casing by releasing the entire volume of the pressurized air. For this test, only the air that was contained within the pipe (2 gallons) was released. At the conclusion of the pressurized air release the surface of the saturated sand within the casing was lowered by 0.9 inches. The initial volume of sand within the casing was 26.7 cubic feet and the final volume of sand within the casing was 25.8 cubic feet (3.6% volumetric strain).

The four tests performed as part of this example show that bursts of air pressurized to 125 psi and released within deposits of saturated sand to depths of at least 9 feet provide sufficient energy to densify the soil. Additional bursts of air that could be applied as the pipe is released are thought to further increase the density of the sand resulting in higher volumetric stains.

CONCLUSION

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. An apparatus for densification of a soil mass, the apparatus comprising:

a. an air delivery primary tube having an upper end and a lower end, the primary tube further comprising,
   i) an open end disposed at the lower end of the primary tube; or
   ii) a plurality of ports formed along a length of the primary tube, b. a closure mechanism disposed within an airflow flowing inside the primary tube, operable to block airflow out of the primary tube while disposed in a soil mass, provided to the open lower end or the plurality of ports repeatedly operable between an open position and a closed position; and, c. a pressurized air system connected to the primary tube, wherein the pressurized air system comprises a stored volume of air connected to an air source, the pressurized air system delivering controlled air bursts into the primary tube and delivering controlled air bursts into the soil mass, and wherein the closure mechanism is transitioned to the open position by
   i) a build up of pressurized air in the primary tube provided by the pressurized air system which triggers a flap mechanism, or
   ii) a rod provided inside the primary tube and mechanically connected to the closure mechanism for actuated opening and closing the closure mechanism.

2. The apparatus of claim 1, wherein the pressurized air system is secured at the upper end of the primary tube.

3. The apparatus of claim 1, wherein the closure mechanism is a valve or a nozzle.

4. The apparatus of claim 3, wherein the closure mechanism comprises a bulbous nozzle that nests within the open end of the tube and is operable between an open position and a closed nested position.

5. The apparatus of claim 1, further comprising a cover covering the open end or the plurality of ports.

6. The apparatus of claim 5, wherein the cover comprises a sacrificial cap with an opening in the center configured for clearance of the closure mechanism.

7. The apparatus of claim 1, wherein the stored volume of compressed air is stored in a compressed air storage tank and the tube.

8. The apparatus of claim 1, wherein the air source comprises an air compressor.

9. The apparatus of claim 1, wherein the air source is configured to recharge the stored volume of compressed air at a rate equal to a discharge volume of air resulting from the air impulse.

10. The apparatus of claim 1, further comprising a control valve located between the stored volume of compressed air and the open end or the plurality of ports.

11. The apparatus of claim 1, wherein the closure mechanism of the primary tube having a plurality of ports comprises a shutter system for selectively opening or closing the plurality of ports spaced along the length of the primary tube.

12. The apparatus of claim 1, further comprising a plurality of primary tubes.

13. The apparatus of claim 12, wherein the plurality of primary tubes are configured to provide substantially simultaneous air impulses.

14. The apparatus of claim 12, wherein the plurality of primary tubes are configured to provide substantially sequential air impulses.

15. The apparatus of claim 1, further configured for delivering flowable media into a void in the soil mass resulting from the air bursts.

16. The apparatus of claim 1, configured for delivering one or more of sand, gravel, recycled materials, waste materials, tire chips, concrete, or grout.

17. The apparatus of claim 1, further comprising a secondary tube for delivering flowable media into a void in the soil mass resulting from the air bursts.

18. The apparatus of claim 17, wherein the primary tube is internal to and concentric with the secondary tube and wherein the offset between the primary tube and secondary tube is substantially constant.

19. The apparatus of claim 17, wherein the secondary tube is external to and alongside the primary tube.

20. The apparatus of claim 17, wherein the primary tube is internal to the secondary tube and wherein the primary tube abuts alongside the secondary.

21. The apparatus of claim 17, configured for delivering one or more of sand, gravel, recycled materials, waste materials, tire chips, concrete, or grout.

* * * * *